US012129859B1

(12) United States Patent
Gattu et al.

(10) Patent No.: US 12,129,859 B1
(45) Date of Patent: Oct. 29, 2024

(54) AXIALLY NESTED COMPRESSORS

(71) Applicant: Honeywell International Inc., Charlotte, NC (US)

(72) Inventors: Raghavendra Gattu, Bangalore (IN); Chandiran Jayamurugan, Bangalore (IN); Bharath Chandra G, Bangalore (IN); Niall McCabe, Torrance, CA (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 18/409,441

(22) Filed: Jan. 10, 2024

(30) Foreign Application Priority Data

Oct. 3, 2023 (IN) ..... 202311066136

(51) Int. Cl.
*F04D 17/12* (2006.01)
*F04D 29/28* (2006.01)
*F04D 29/44* (2006.01)

(52) U.S. Cl.
CPC ..... *F04D 17/12* (2013.01); *F04D 29/286* (2013.01); *F04D 29/442* (2013.01); *F04D 29/444* (2013.01)

(58) Field of Classification Search
CPC .... F04D 29/284; F04D 29/286; F04D 29/442; F04D 29/447; F04D 17/127
See application file for complete search history.

(56) References Cited

U.S. PATENT DOCUMENTS 2,203,843 A * 6/1940 Pierce ..... F04D 25/022 415/61
2,845,216 A * 7/1958 Sallou ..... F04D 29/288 415/198.1
3,751,178 A * 8/1973 Paugh ..... F04D 1/06 415/199.1
7,600,961 B2 10/2009 Abdallah
10,648,480 B2 * 5/2020 Echeverri ..... F04D 29/2294
11,401,944 B2 * 8/2022 Yamashita ..... F04D 29/284
(Continued)

FOREIGN PATENT DOCUMENTS

CN 102691678 A 9/2012
CN 102767538 A 11/2012
CN 205895702 U 1/2017
(Continued)

*Primary Examiner* — Justin D Seabe
(74) *Attorney, Agent, or Firm* — Shumaker & Sieffert, P.A.

(57) ABSTRACT

A compressor comprising: a first compressor wheel comprising a first chamber configured to retain a medium, a first impeller disposed within the first chamber and configured to revolve around a longitudinal axis of the compressor, and a first diffuser coupled to the first chamber; and a second compressor wheel comprising a second chamber disposed radially outwards of the first chamber relative to the longitudinal axis, wherein the second chamber is configured to receive the outputted medium from the first chamber, a second impeller disposed within the second chamber and configured to revolve around the longitudinal axis of the compressor within the second chamber, and a second diffuser coupled to the second chamber, wherein each blade of the first impeller defines a fillet extending along an outer edge of the blade, and wherein a width of the fillet along a surface of the respective blade varies along the longitudinal axis.

20 Claims, 9 Drawing Sheets

(56) References Cited

U.S. PATENT DOCUMENTS

| | | | | |
|---|---|---|---|---|
| 11,971,050 | B2 * | 4/2024 | Kilchyk | F04D 27/0246 |
| 2004/0154309 | A1 * | 8/2004 | Bernard | F02C 3/09 60/805 |

FOREIGN PATENT DOCUMENTS

| | | | |
|---|---|---|---|
| GB | 2485835 | A | 5/2012 |
| JP | 2757922 | B2 | 5/1998 |

* cited by examiner

AXIALLY NESTED COMPRESSORS

This application claims the benefit of Indian Provisional Application No. 202311066136 filed Oct. 3, 2023 and entitled "AXIALLY NESTED COMPRESSORS," the entire contents of which is incorporated herein by reference.

TECHNICAL FIELD

The present disclosure relates to systems and techniques for producing conditioned air for a vehicle, and more particularly, to compressor systems and techniques for producing compressed vapor refrigerant.

BACKGROUND

A vapor cycle system may cool a fresh air stream using a refrigerant. The vapor cooling system compresses and condenses the refrigerant from a relatively low-pressure vapor to a relatively high-pressure liquid, which then expands and evaporates to remove heat from the fresh air stream.

SUMMARY

A vapor cycle system (VCS) may monitor and control the temperatures of systems and/or components within a vehicle. VCS may include one or more centrifugal compressors which compresses and condenses a refrigerant flowing within the VCS from a relative-low pressure vapor to a relatively high-pressure fluid. In some examples, a compressor system of a VCS may include multiple centrifugal compressors coupled in series to cause the compressor system to output the refrigerant at a specific pressure ratio (e.g., a ratio of the pressure of the refrigerant at an output of the compressor system to the pressure of the refrigerant at an input of the compressor system. When multiple compressors are coupled in series, each compressor may receive the refrigerant from an output of a preceding compressor in the series and output the refrigerant directly into a succeeding compressor in the series.

Other compressor systems including multiple compressors coupled in series may include two separate compressor wheels that are coupled along a longitudinal axis or a dual-stage compressor wheel with separate impellers on opposite sides on the compressor wheel. Such designs may require increased space within a vehicle, increased weight allowances, increased packaging requirements, and increased production cost relative to a compressor system with a single compressor.

The disclosure describes an example compressor system with a nested compressor architecture. One compressor wheel may be positioned radially within and longitudinally aligned with another compressor wheel along a longitudinal axis of a compressor of the example compressor system. The compressor wheels may be fluidically connected to allow the compressor wheels to run in series.

The example compressor system may provide several advantages over other compressor systems with multiple compressors or compressor wheels coupled in series. The example compressor system described herein may exhibit reduced space requirements, complexity, weight requirements, and/or packaging space compared to another compressor system with multiple compressors or compressor wheels coupled in series. Additionally, components of the example compressor system described herein may include other elements which may increase the performance and/or efficiency of the example compressor system relative to other example compressor systems.

In some examples, the disclosure is directed to a compressor comprising: a first compressor wheel comprising: a first chamber configured to retain a medium; a first impeller disposed within the first chamber, wherein the first impeller is configured to revolve around a longitudinal axis of the compressor and within the first chamber, and wherein the first impeller comprises a plurality of blades; and a first diffuser fluidically connected to the first chamber and configured to output the medium from the first chamber; and a second compressor wheel comprising: a second chamber disposed radially outwards of the first chamber relative to the longitudinal axis, wherein the second chamber is separated from the first chamber by an outer wall of the first chamber, and wherein the second chamber is configured to receive the outputted medium from the first chamber; a second impeller disposed within the second chamber, wherein the second impeller is configured to revolve around the longitudinal axis of the compressor within the second chamber; and a second diffuser fluidically connected to the second chamber, wherein the second diffuser is configured output the medium from the second chamber, wherein each blade of the plurality of blades defines a fillet extending along a radially outward-most edge of the respective blade, and wherein a width of the fillet along a surface of the respective blade varies along the longitudinal axis.

In some examples, the disclosure is directed to a compressor comprising: a first compressor wheel comprising: a first chamber configured to retain a medium; a first impeller disposed within the first chamber, wherein the first impeller is configured to revolve around a longitudinal axis of the compressor and within the first chamber; and a first diffuser fluidically connected to the first chamber, wherein the first diffuser is configured to output the medium from the first chamber; and a second compressor wheel comprising: a second chamber disposed radially outwards of the first chamber relative to the longitudinal axis, wherein the second chamber is separated from the first chamber by a first outer wall, wherein the second chamber is configured to receive the outputted medium from the first chamber, and wherein the second chamber comprises a second outer wall radially outwards of the first outer wall; a second impeller disposed within the second chamber and radially inwards of the second outer wall, wherein the second impeller is configured to revolve around the longitudinal axis within the second chamber; and a second diffuser fluidically connected to the second chamber, wherein the second diffuser is configured output the medium from the second chamber, wherein the second outer wall shrouds the second chamber from a first opening of the second chamber to a second opening of the second chamber and around an outer circumference of the second chamber.

In some examples, the disclosure is directed to a method of manufacturing a compressor. The compressor comprises: a first compressor wheel comprising: a first chamber configured to retain a medium; a first impeller disposed within the first chamber, wherein the first impeller is configured to revolve around a longitudinal axis of the compressor and within the first chamber, and wherein the first impeller comprises a plurality of blades; and a first diffuser fluidically connected to the first chamber and configured to output the medium from the first chamber; and a second compressor wheel comprising: a second chamber disposed radially outwards of the first chamber relative to the longitudinal axis, wherein the second chamber is separated from the first chamber by an outer wall of the first chamber, and wherein the second chamber is configured to receive the outputted medium from the first chamber; a second impeller disposed within the second chamber, wherein the second impeller is configured to revolve around the longitudinal axis of the compressor within the second chamber; and a second diffuser fluidically connected to the second chamber, wherein the second diffuser is configured output the medium from the second chamber, wherein each blade of the plurality of blades defines a fillet extending along a radially outwardmost edge of the respective blade, and wherein a width of the fillet along a surface of the respective blade varies along the longitudinal axis. The method comprises: forming the first chamber around the longitudinal axis; disposing the first impeller within the first chamber; affixing the first diffuser to the first chamber; disposing the second chamber radially outwards of the first chamber relative to the longitudinal axis; disposing the second impeller within the second chamber; and affixing the second diffuser to the second chamber.

In some examples, the disclosure is directed to a method of manufacturing a compressor. The compressor comprises: a first compressor wheel comprising: a first chamber configured to retain a medium; a first impeller disposed within the first chamber, wherein the first impeller is configured to revolve around a longitudinal axis of the compressor and within the first chamber; and a first diffuser fluidically connected to the first chamber, wherein the first diffuser is configured to output the medium from the first chamber; and a second compressor wheel comprising: a second chamber disposed radially outwards of the first chamber relative to the longitudinal axis, wherein the second chamber is separated from the first chamber by a first outer wall, wherein the second chamber is configured to receive the outputted medium from the first chamber, and wherein the second chamber comprises a second outer wall radially outwards of the first outer wall; a second impeller disposed within the second chamber and radially inwards of the second outer wall, wherein the second impeller is configured to revolve around the longitudinal axis within the second chamber; and a second diffuser fluidically connected to the second chamber, wherein the second diffuser is configured output the medium from the second chamber, wherein the second outer wall shrouds the second chamber from a first opening of the second chamber to a second opening of the second chamber and around an outer circumference of the second chamber. The method comprises: forming the first chamber around the longitudinal axis; disposing the first impeller within the first chamber; affixing the first diffuser to the first chamber; disposing the second chamber radially outwards of the first chamber relative to the longitudinal axis; disposing the second impeller within the second chamber; and affixing the second diffuser to the second chamber.

The details of one or more examples are set forth in the accompanying drawings and the description below. Other features, objects, and advantages will be apparent from the description and drawings, and from the claims.

BRIEF DESCRIPTION OF THE FIGURES

The details of one or more examples are set forth in the accompanying drawings and the description below. Other features, objects, and advantages will be apparent from the description and drawings, and from the claims.

Like reference characters refer to like elements throughout the figures and description.

DETAILED DESCRIPTION

Figure 1:
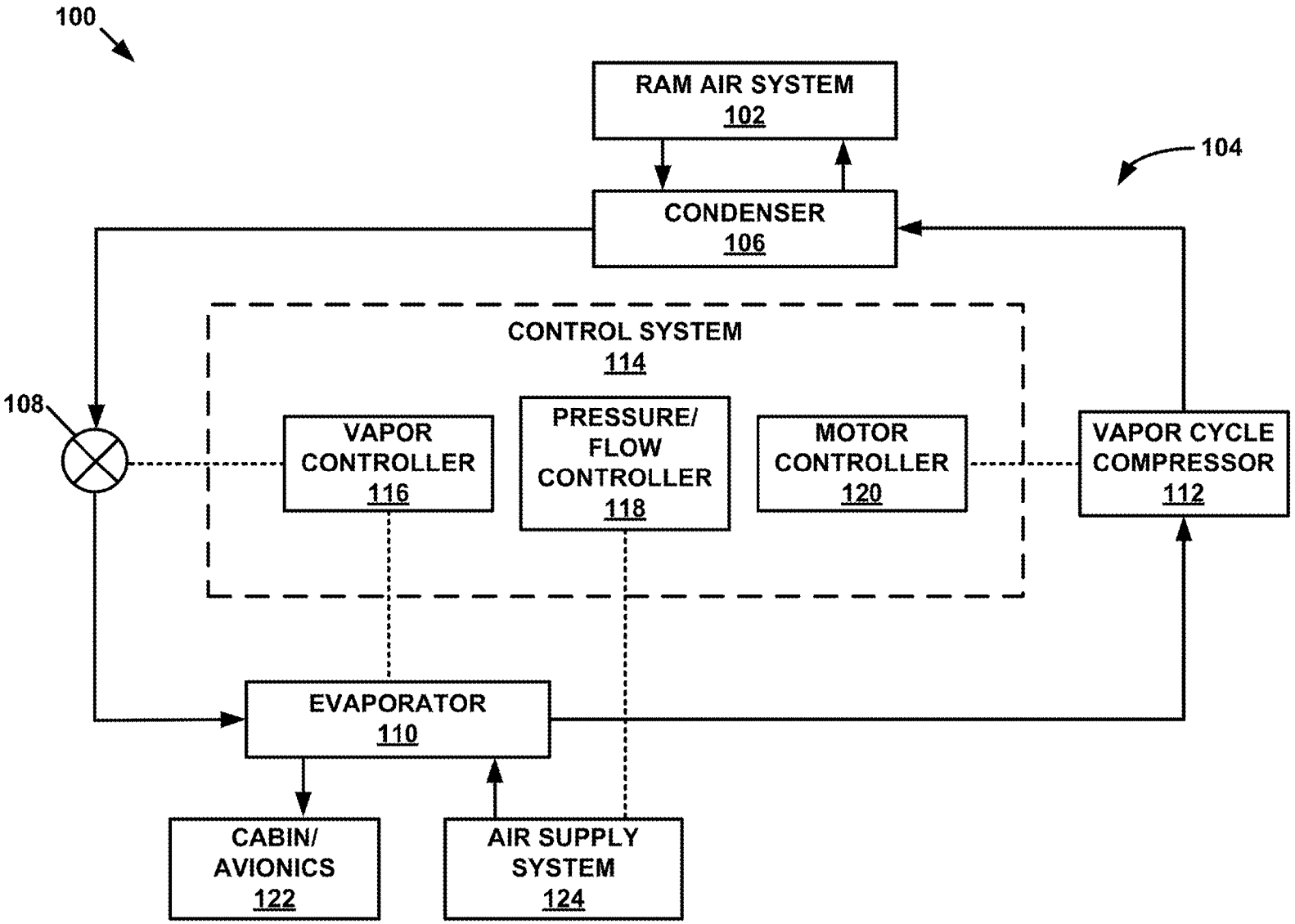
FIG. 1 is a block diagram illustrating a system for generating conditioned air that includes an example vapor cooling system (VCS).

Various examples discussed herein describe vapor cooling systems, vapor compression systems, centrifugal compressors, centrifugal compressor systems, and centrifugal compressor components that include two or more compressor wheels coupled in series and in a nested configuration.

A centrifugal compressor system is configured to drive one or more impellers of one or more compressor wheels using a compressor motor to compress a vapor refrigerant to a higher pressure. Compressor wheels may be coupled in series to increase a pressure ratio generated by the compressor system. In such examples, a first compressor wheel may compress a refrigerant and may output the refrigerant directly into a second compressor wheel. The second compressor wheel may then further compress the refrigerant, thereby increasing the pressure ratio of the refrigerant. Multiple impellers of multiple compressor wheels coupled in series may be driven by a same compressor motor.

In some examples, a centrifugal compressor system with multiple compressor wheels coupled in series may position multiple compressor wheels along a longitudinal axis. For example, a first-stage compressor wheel may be proximal to a second-stage compressor wheel. Such positioning may increase the length and space requirements for the compressor system. In some examples, a centrifugal compressor system may increase the pressure ratio via inclusion of a dual-stage compressor wheel, where the compressor wheel includes two separate impellers disposed on opposite faces of the compressor wheel. A compressor system with a dual-stage compressor requires a housing with increased space allocations to direct refrigerant towards both impellers, thereby increasing the length, width, and complexity of the compressor system.

The disclosure describes a compressor system with two or more compressor wheels in a nested configuration. For example, one compressor wheel is disposed radially within another compressor wheel. The compressor wheels of the example compressor system described herein may be longitudinally overlapping, thereby reducing the length and volume of the compressor system. The housing of the compressor system may direct refrigerant from the outlet of one compressor wheel into the outlet of a radially outward compressor wheel, thereby fluidically coupling the compressor wheels in series.

The compressor wheels may be driven by a single drive shaft and/or may be formed into a single component, thereby reducing complexity and cost requirements to manufacture the compressor system. In some examples, the compressor system includes additional components (e.g., shroud(s) for the compressor wheels, vaned diffusers at outlets of compressor wheels, seals between compressor wheels, mixed flow exducers at outlets of compressor wheels, or the like) which may increase the efficiency of the compressor system. Each of the additional components are described in greater detail below.

The compressor system described herein may provide advantages over other compressor systems including compressor wheels coupled in series and/or compressor systems configured to increase the pressure ratio of the refrigerants. The compressor system described here may define reduced length, volume, or weight, which may enable the compressor system to be installed in vehicles with reduced available volume (e.g., vehicles configured to operate in urban environments, vehicles with reduced profiles). The compressor system described herein may be less complex and less costly to manufacture than other compressor systems due to the reduced complexity of the housing of the compressor system and/or the reduced complexity of the arrangement of the compressor wheels. Components of the compressor system described herein may also occupy reduced packaging volume compared to the components of other compressor systems, thereby simplifying transportation and/or delivery of the compressor system.

Vapor cooling systems, compressors, compressor systems, and compressor components discussed herein may be used to produce conditioned air for a variety of applications. In some examples, vapor cooling systems discussed herein may be used to cool pressurized air, such as for a pressurized cabin or avionics systems of an aircraft. In some examples, vapor cooling systems, including vapor-cooled compression systems, may be used, for aircraft and non-aircraft implementations, to cool liquid, non-pressurized air, etc., in accordance with one or more of the various techniques of this disclosure. In another example, vapor cooling systems, including vapor-cooled compression systems, may be used, for aircraft and non-aircraft implementations, to cool equipment, such as through direct contact-cooling of equipment.

FIG. 1 is a block diagram illustrating an example system 100 for generating conditioned air that includes a vapor cooling system (VCS) 104. The conditioned air may be used to cool volumes or components of various cabins or avionics systems 122. Cabin/avionics 122 may be a compartment of a vehicle (e.g., an aircraft, an automobile, a spacecraft, a watercraft, etc.) that includes an internal environment and/or one or more avionics systems that receive cooled air for cooling equipment. For example, cabin/avionics 122 may be configured to house people, cargo, and the like, in the internal environment. It will be understood that avionics generally relate to aircraft, spacecraft, etc., and that other systems may include other electronic systems/control systems configured for cooling. Thus, while described as cabin/avionics 122, the techniques of this disclosure are not so limited, and a person skilled in the art will understand that the systems described herein may be employed in a variety of contexts without significantly departing from structures and mechanics described herein.

VCS 104 includes a vapor cycle compressor (VCC) 112, a condenser 106, an expansion device 108 (e.g., an expansion valve), and an evaporator 110 fluidically coupled to each other through pressurized refrigerant supply lines to form a refrigerant circuit. A variety of refrigerants may be used in VCS 104, as will be explained further below.

VCC 112 may be configured to receive vapor refrigerant from evaporator 110 and compress and pump vapor refrigerant to condenser 106. VCC 112 may include a centrifugal compressor system configured to receive the vapor refrigerant at an inlet pressure and discharge the vapor refrigerant at a higher outlet pressure. VCC 112 may include one or more compression stages and an electrically driven motor. The motor may be configured to receive electrical power, such as from a motor controller 120, and generate mechanical power to drive the one or more compression stages. Condenser 106 may be configured to receive saturated vapor refrigerant from VCC 112, condense the vapor refrigerant, and discharge saturated refrigerant to an expansion device 108. Condenser 106 may be cooled by environmental air, such as ram air flow, from a ram air system 102, or another fluid such as fuel or heat transport fluids.

Expansion device 108 may be configured to control flow of refrigerant to evaporator 110 and reduce a pressure of saturated refrigerant prior to entry into evaporator 110. Expansion device 108 may be an orifice, tube, metered valve, or other device configured to reduce a pressure of a saturated refrigerant. Evaporator 110 may be configured to receive cabin pressure air, such as from an air supply system 124, remove heat from cabin air using a refrigerant, and discharge cabin air to cabin/avionics 122. On a refrigerant side, evaporator 110 may be configured to receive saturated refrigerant, absorb heat from the cabin air, vaporize the refrigerant, and discharge superheated vapor refrigerant.

System 100 includes a control system 114 for controlling various conditions of VCS 104, such as refrigerant flow rate, refrigerant vapor composition, refrigerant temperature, and the like. Control system 114 may be configured to monitor and/or operate one or more process control components of system 100. For example, control system 114 may be communicatively coupled to any of air supply system 124, ram air system 102, VCC 112, expansion device 108, or any other component of system 100. Control system 114 may also be communicatively coupled to instrumentation, such as flow meters, temperature sensors, and pressure sensors, and configured to receive measurement signals from the instrumentation. For example, control system 114 may be configured to receive measurement signals for various parameters of VCS 104, such as a speed of VCC 112, temperature of cabin air leaving evaporator 110, or a superheat of vapor refrigerant entering VCC 112, determine a mismatch between the measurement signals and a setpoint for the corresponding parameter, and send a control signal to one or more components of system 100 to reduce the mismatch and return the parameter to within the setpoint. Control system 114 may include any of a wide range of devices, including processors (e.g., one or more microprocessors, one or more application specific integrated circuits (ASICs), one or more field programmable gate arrays (FPGAs), or the like), servers, desktop computers, notebook (i.e., laptop) computers, tablet computers, and the like.

Control system 114 may include a motor controller 120 configured to control a motor of VCC 112. As discussed above, a motor may provide mechanical power to impellers of VCC 112, and therefore modulate flow rate of refrigerant through VCS 104. The speed of VCC 112 may correspond to various temperature setpoints of VCS 104, such as cooling demands of evaporator 110 and inlet superheat of the vapor refrigerant into VCC 112. To control a speed of VCC 112, motor controller 120 may be configured to send control signals to VCC 112 to control an amount of electrical power to the motor of VCC 112, such as from an APU or other power supply. Control system 114 may include a vapor controller 116 configured to control a vapor composition of the refrigerant in VCS 104. To control a vapor composition of the refrigerant, vapor controller 116 may be configured to send control signals to expansion device 108 and/or evaporator 110 to control a position of expansion device 108 and/or a position of a bypass valve of evaporator 110, such as by closing expansion device 108 to increase a superheat of the refrigerant entering VCC 112. Control system 114 may include a pressure/flow controller 118 configured to control pressure and/or flow of supply air to evaporator 110. In some examples, pressure/flow controller 118 may be configured to control air supply system 124 to generate a particular flow of supply air from air supply system 124. For example, pressure/flow controller 118 may be configured to send control signals to air supply system 124 to control a pressure of supply air, such as by controlling an amount of bleed air or a speed of a load compressor (via an APU) or cabin air compressor. In some examples, pressure/flow controller 118 may be configured to control ram air system 102 in order to receive a particular flow of supply air from ram air system 102.

Vapor cooling system (e.g., vapor compression systems) discussed herein may include a centrifugal compressor to compress a vapor refrigerant and cool various components of the compressor using the vapor refrigerant as a cooling medium. For example, a compressor motor, shaft bearings, and other components of the centrifugal compressor that receive power and/or experience friction may produce heat that needs to be removed. Rather than remove this heat using external cooling, which may be heavy or inefficient to operate, centrifugal compressors described herein may use the incoming vapor refrigerant to cool various components of the centrifugal compressor, thereby reducing or eliminating external cooling of the centrifugal compressor.

Figure 2:
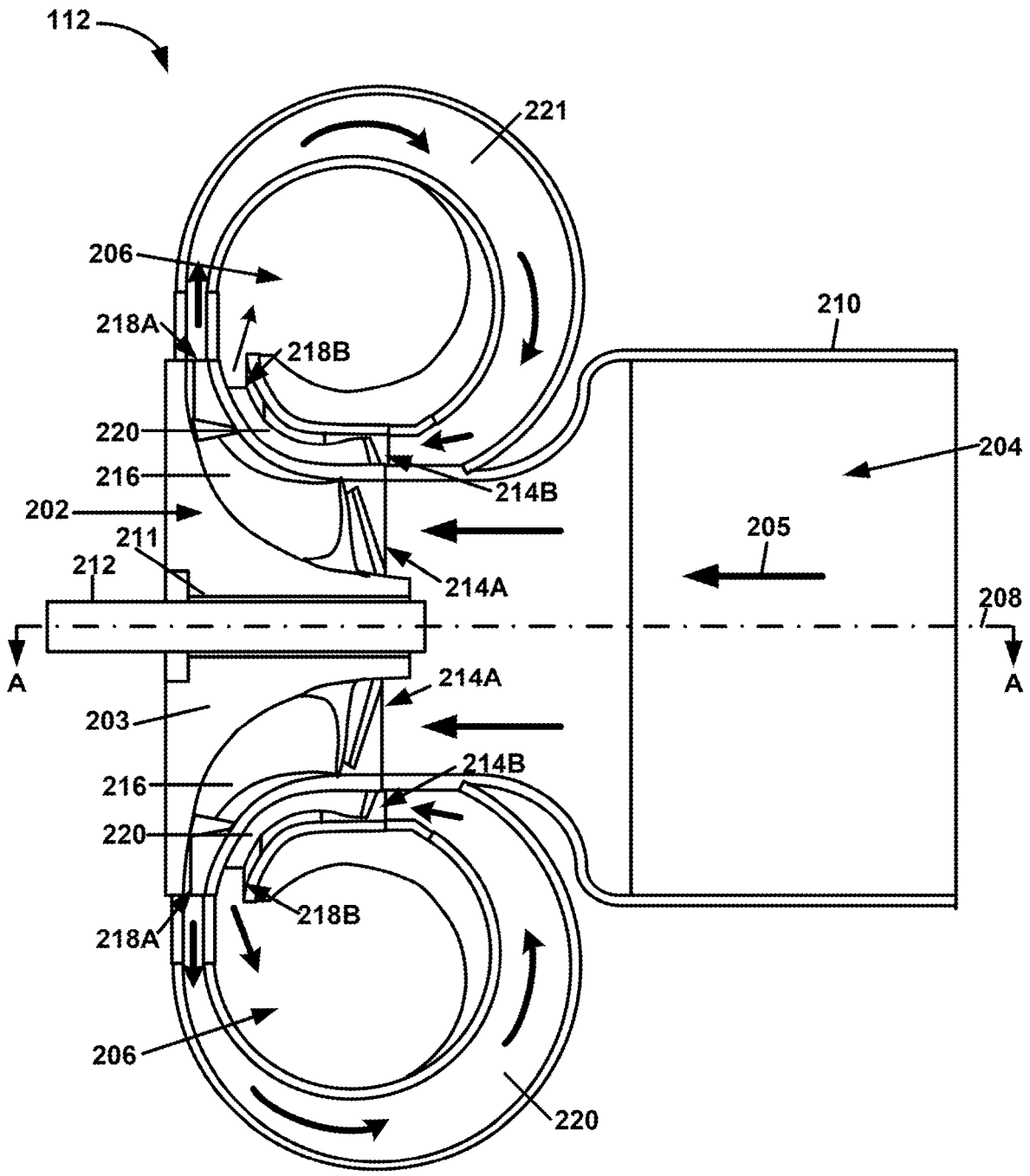
FIG. 2 is a conceptual diagram illustrating an example vapor cycle compressor (VCC).

Centrifugal compressors described herein may be configured to form a relatively tight containment to hermetically seal the vapor refrigerant within the vapor compression system. FIG. 2 is a conceptual diagram illustrating an example VCC 112. VCC 112 may include a centrifugal compressor 202. VCC 112 may extend along a longitudinal axis 208 and may include a centrifugal compressor 202 (also referred to herein as "compressor 202") disposed within a compressor housing 210 of VCC 112. Compressor 202 may include a first compressor wheel 216 nested radially within a second compressor wheel 220. VCC 112 may direct refrigerant 205 through from inlet port 204 of housing 210 through centrifugal compressor 202 (e.g., through both first compressor wheel 216 and second compressor wheel 220 in series) and out of one or more outlet port(s) 206 of housing 210. Refrigerant 205 may enter VCC 112 at inlet port 204 from evaporator 110 of VCS 104 and exit VCC 112 at outlet port(s) 206 into condenser 106 of VCS 104. While FIG. 2 illustrates compressor 202 as including two nested compressor wheels (i.e., first compressor wheel 216 and second compressor wheel 220), other example compressors 202 described herein may include three or more nested compressor wheels.

Compressor 202 may include a compressor body 203 extending along and around longitudinal axis 208. Compressor body 203 may define a cylindrical body around longitudinal axis 208. First compressor wheel 216 may be disposed radially outward of compressor body 203. First compressor wheel 216 may be affixed to compressor body 203. A housing of first compressor wheel 216 defining a first chamber may be affixed to compressor body 203 and, in some examples, an impeller of first compressor wheel 216 may be affixed to compressor body 203. Second compressor wheel 220 may be affixed to first compressor wheel 216 and may, by extension, be affixed to compressor body 203.

Compressor body 203 may define a channel 211 extending at least partially through compressor body 203. Channel 211 may be configured to retain a drive shaft 212 extending from a centrifugal motor. Compressor 202 may include features disposed within channel 211 or on compressor body 203 which may removably or permanently affix compressor 202 to drive shaft 212. When compressor 202 is affixed to drive shaft 212, rotation of drive shaft 212 may cause compressor 202 to rotate about longitudinal axis 208, thereby causing impellers within first compressor wheel 216 and second compressor wheel 220 to compress refrigerant 205.

First compressor wheel 216 may be disposed radially outwards of compressor body 203 relative to longitudinal axis 208. First compressor wheel 216 may define a first chamber configured to retain refrigerant 205. The first chamber may extend from inlet 214A to outlet 218A. First compressor wheel 216 may include an impeller disposed within the first chamber. The impeller may include one or more blades configured to rotate about longitudinal axis 208. Refrigerant 205 may enter first compressor wheel 216 via inlet 214A and exit first compressor wheel 216 via outlet 218A. Each of inlet 214A and outlet 218A may extend at least partially around longitudinal axis 208. For example, inlet 214A and/or outlet 218A may define a complete ring around longitudinal axis 208.

Second compressor wheel 220 may be disposed radially outwards of first compressor wheel 216. Second compressor wheel 220 may define a second chamber configured to retain refrigerant 205. The second chamber may be separated from the first chamber of first compressor wheel 216 via an outer wall of the first chamber and/or an inner wall of the second chamber. The second chamber may extend from inlet 214B to outlet 218B. Second compressor wheel 220 may include a second impeller disposed within the second chamber. The second impeller may include one or more blades configured to rotate about longitudinal axis 208. Refrigerant 205 may flow from outlet 218A of first compressor wheel 216 into second compressor wheel 220 via inlet 214B and exit second compressor wheel 220 via outlet 218B. Each of inlet 214B and outlet 218B may extend at least partially around longitudinal axis 208. For example, inlet 214B and/or outlet 218B may define a complete ring around longitudinal axis 208.

Housing 210 may define one or more channels 221 fluidically connecting outlet 218A to inlet 214B. Channel(s) 221 may be fully enclosed and may revolve at least partially around longitudinal axis 208. For example, as illustrated in FIG. 2, channel(s) 221 may define a torus shape radially outwards of compressor 202. Refrigerant 205 may exit outlet 218B and into outlet port 206 of VCC 112.

Outlet port 206 may be configured to output refrigerant 205 out of VCC 112. Outlet port 206 may define one or more openings fluidically coupled to a downstream component within the refrigeration circuit (e.g., condenser 106). In some examples, as illustrated in FIG. 2, outlet port 206 defines a torus shape radially outwards of compressor 202 and channel(s) 221 are disposed radially outwards of and/or around outlet port 206.

Portions of housing 210 may be sealed to form an enclosure for compressor 202. Portions of housing 210 (e.g., portion(s) defining inlet port 204, portion(s) defining channel(s) 221, portion(s) defining outlet port 206) may be affixed to each other via one or more mechanisms or fixation features including, but are not limited to, bolts, screws, welds, adhesives, or the like. Housing 210 may hermetically seal refrigerant 205 from an environment outside of VCC 112 aside from inlet port 204 and outlet port 206

Refrigerant 205 may include a low-pressure refrigerant (e.g., a refrigerant having a relatively low saturation vapor pressure). For example, the refrigerant gas may be R-1233zd, r236fa, or r245fa, or a similar low-pressure refrigerant, as described herein.

A compressor motor may be coupled to drive shaft 212 and may be configured to rotate drive shaft 212 to rotate compressor 202. The centrifugal motor may include windings of a stator coupled to compressor 202 and/or housing 210 and a rotor coupled to drive shaft 212. Windings of the stator may be configured to receive an electrical signal from motor controller 120 and generate a dynamic magnetic field to drive the rotor. In some examples, the compressor motor may be configured to rotate compressor 202 at about 80,000 rotations per minute (RPM) or greater. For example, the compressor motor may be configured to spin compressor 202 at approximately 120,000 RPM.

Figure 3:
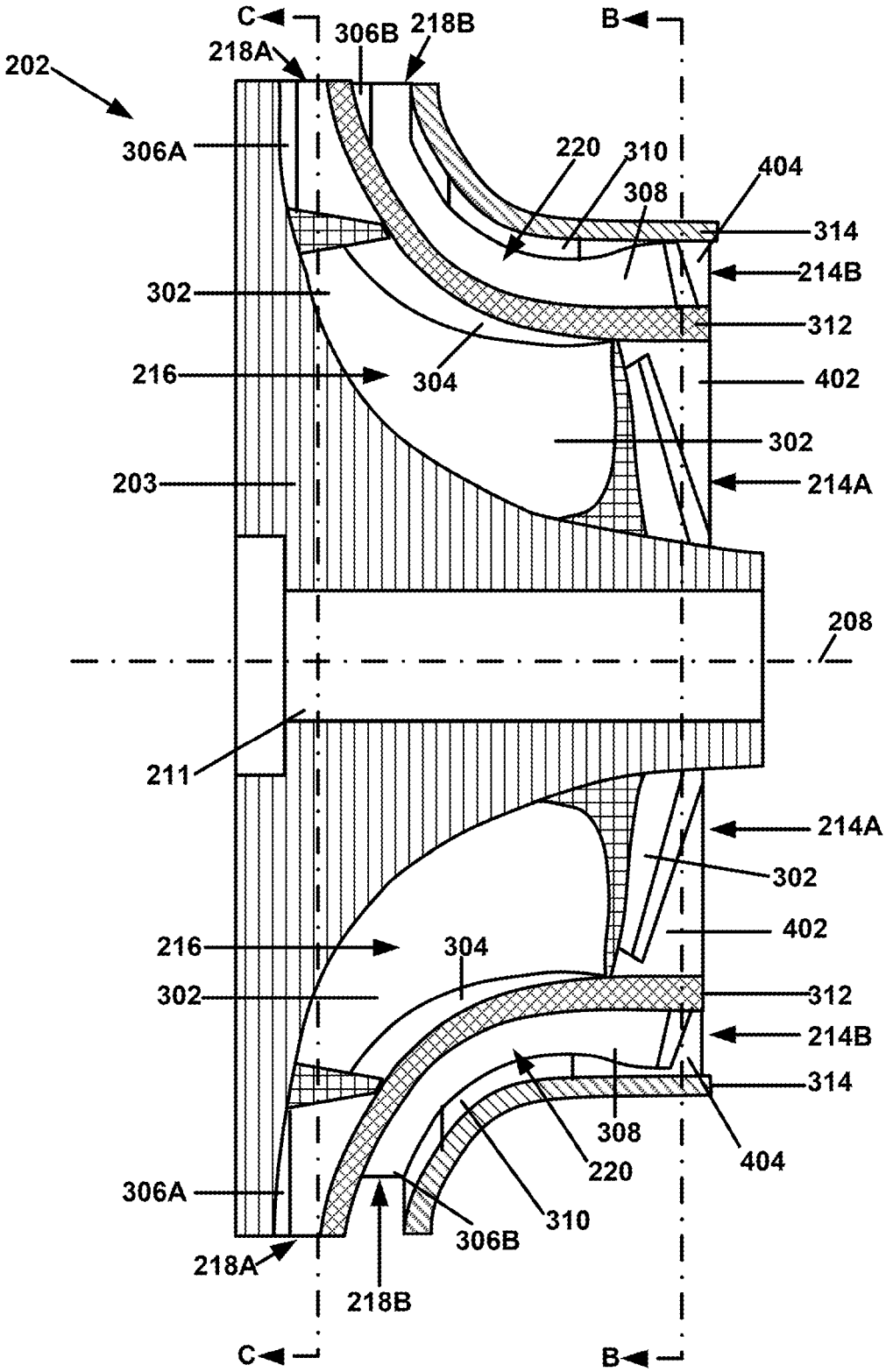
FIG. 3 is a conceptual diagram illustrating a cross-sectional view of the example centrifugal compressor of FIG. 2, the cross-section being taken along line A-A of FIG. 2.

FIG. 3 is a conceptual diagram illustrating a cross-sectional view of the example centrifugal compressor 202 of VCC 112 of FIG. 2, the cross-section being taken along line A-A of FIG. 2. As illustrated in FIG. 3, first compressor wheel 216 may include a first impeller 302 disposed within a first chamber 402 and second compressor wheel 220 may include a second impeller 308 within a second chamber 404. First chamber 402 may extend from inlet 214A to outlet 218A and may include first diffuser 306A disposed at outlet 218A. Second chamber 404 may extend from inlet 214B to outlet 218B and may include second diffuser 306B disposed at outlet 218B. First chamber 402 and second chamber 404 may be separated by wall 312. In some examples, as illustrated in FIG. 3, second chamber 404 and second impeller 308 may be at least partially shrouded by wall 314.

First compressor wheel 216 may be disposed radially outwards of compressor body 203 relative to longitudinal axis 208 and may include first chamber 402, first impeller 302 disposed within first chamber 402, and first diffuser 306A coupled to the first chamber at outlet 218A. First chamber 402 may be enclosed from inlet 214A to outlet 218A and around the circumference of First chamber 402. First chamber 402 may be configured to retain refrigerant 205 entering compressor 202 from inlet port 204 of housing 210. First impeller 302 may be disposed within first chamber 402. In some examples, as illustrated in FIG. 3, first impeller 302 may be integral to first chamber 402. First impeller 302 may include a plurality of blades, each blade extending from inlet 214A towards outlet 218A. In some examples, each blade may extend from inlet 214A to outlet 218A. Each blade may extend at least partially or entirely from an outer surface of compressor body 203 defining a radially inner surface of the first chamber to wall 312 defining a radially outward surface of first chamber 402. Wall 312 may be an outer wall of first chamber 402.

When compressor 202 rotates about longitudinal axis 208, the blades of first impeller 302 impart kinetic energy to and increase speed of refrigerant 205 within first chamber 402. The blades of first impeller 302 may define a fillet 304 at the radially-outward-most edges of the blades. Fillet 304 may reduce stress concentration at the edges of the blades and increase longevity of first impeller 302. As illustrated in FIG. 3, fillet 304 may vary in width (e.g., may increase in width) along the longitudinal length of each blade.

First compressor wheel 216 may include first diffuser 306A disposed within first chamber 402 at or near outlet 218A. In some examples, first diffuser 306A is disposed outside of first compressor wheel 216 and is fluidically coupled to first chamber 402, e.g., at outlet 218A. First diffuser 306A may reduce the speed of refrigerant 205 exiting first chamber 402, thereby increase the pressure of refrigerant 205. First diffuser 306A may remain stationary relative to first impeller 302 and may cause refrigerant 205 exiting first impeller 302 to decelerate, which may lead to an increase in static pressure of refrigerant 205. First diffuser 306A may include one or more feature (e.g., vanes) which may cause refrigerant 205 to decelerate.

Second compressor wheel 220 includes a second chamber 404 extending from inlet 214B to outlet 218B, second impeller 308 disposed within second chamber 404, and second diffuser 306B coupled to second chamber 404 at outlet 218B. Refrigerant 205 may flow along channel(s) 221 of housing 210 from outlet 218A and into second chamber 404 via inlet 214B. Second chamber 404 may be isolated from the first chamber by wall 312. Wall 312 inhibits flow of refrigerant 205 between the first chamber and second chamber 404 within compressor 202.

Second impeller 308 includes a plurality of blades extending from inlet 214B towards outlet 218B. In some examples, each blade extends from inlet 214B to outlet 218B. Each blade may define a fillet 310 at a radially-outward-most edge, e.g., to reduce stress concentration at the edge of the blade. A width of fillet 310 may vary along a longitudinal length of the blade.

Second compressor wheel 220 includes second diffuser 306B coupled to second chamber 404 at or near outlet 218B. In some examples, second diffuser 306B may be disposed outside of compressor 202 but may be fluidically connected to second compressor wheel 220, e.g., at outlet 218B. Second compressor wheel 220 functions in a same way as first compressor wheel 216 to pressure refrigerant 205 contained within second chamber.

In some examples, second compressor wheel 220 may not be shrouded, such that a portion of housing 210 defines an outer wall (e.g., wall 314) of second chamber 404. In some examples, as illustrated in FIG. 3, second compressor wheel 220 is shrouded, such that an wall 314 integral to second compressor wheel 220 extends from inlet 214B to outlet 218B and around an entire outer circumference of second compressor wheel 220. Shrouding second compressor wheel 220 may increase the efficiency of second compressor wheel 220 by reducing the effects of friction on refrigerant 205 and/or by reducing unintended loss of refrigerant 205 from within second compressor wheel 220.

First compressor wheel 216 and second compressor wheel 220 may be manufactured separately or as a single component. In some examples, a manufacturing system may manufacture first compressor wheel 216 and second compressor wheel 220 separately, nest first compressor wheel 216 within second compressor wheel 220, and affix first compressor wheel 216 to second compressor wheel 220. In some examples, a manufacturing system forms second compressor wheel 220 directly onto first compressor wheel 216. For example, the manufacturing system may form second impeller 308 directly on top of wall 312 and then form wall 314 directly onto second impeller 308. The manufacturing system may form one or more of first compressor wheel 216 or second compressor wheel 220 via three-dimensional (3D) printing or other additive manufacturing techniques.

Figure 4A:
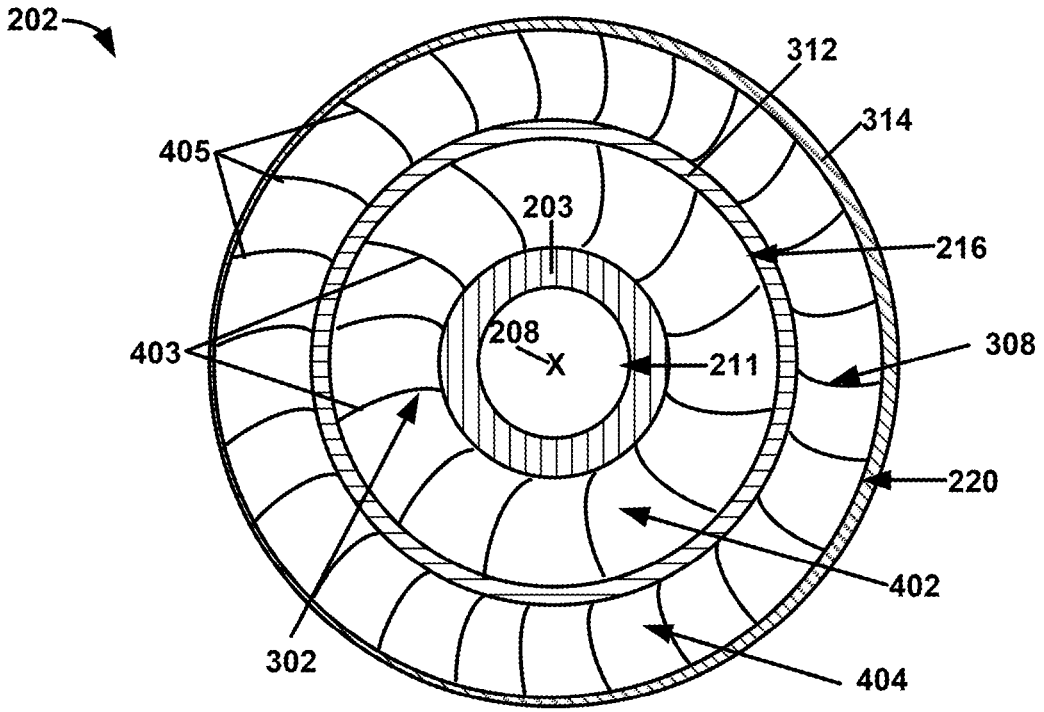
FIG. 4A is a conceptual diagram illustrating a cross-sectional view of the example centrifugal compressor of FIG. 2, the cross-section being taken along line B-B of FIG. 3.

FIG. 4A is a conceptual diagram illustrating a cross-sectional view of the example centrifugal compressor of FIG. 2, the cross-section being taken along line B-B of FIG. 3. As illustrated in FIG. 4A, first compressor wheel 216 and second compressor wheel 220 are disposed radially outwards of compressor body 203. Second compressor wheel 220 is disposed radially outwards of first compressor wheel 216 and is separated from first compressor wheel 216 by wall 312.

First compressor wheel 216 include first impeller 302 disposed within first chamber 402. First impeller 302 includes a plurality of blades 403. Each of blades 403 may extend from an outer surface of compressor body 203 to wall 312. As illustrated in FIG. 4A, each of blades 403 may define a curvature along the cross-sectional length of blades 403 from compressor body 203 to wall 312. The curvature of blades 403 may facilitate transmission of energy from drive shaft 212 to refrigerant 205 within first chamber 402, thereby increasing pressure ratio for first compressor wheel 216. First impeller 302 may include any number of blades 403. First impeller 302 may include twelve blades 403, as illustrated in FIG. 4A, less than twelve blades 403, or more than twelve blades 403. Blades 403 may be equally distributed around a circumference of first impeller 302.

Second compressor wheel 220 includes second impeller 308 disposed within a second chamber 404. As illustrated in FIG. 4A, second chamber 404 is disposed radially outwards of first chamber 402 and is separated from first chamber 402 by wall 312. In some examples, as illustrated in FIG. 4A, second compressor wheel 220 may be shrouded, wherein an wall 314 of second chamber 404 extends from inlet 214B to outlet 218B and around an entire circumference of second chamber 404. Second impeller 308 includes a plurality of blades 405. Each of blades 405 may extend from wall 312 to wall 314 and/or an outer circumference of second chamber 404. Blades 405 may be affixed to and/or integral to the rest of compressor 202 (e.g., to wall 312). Second impeller 308 may have less than, twelve, or more than twelve blades 405. Blades 405 may be equally spaced around the circumference of second impeller 308. Each of blades 405 define a curvature from wall 312 to wall 314. The curvature for blades 405 may be the same as or different the curvature for blades 403. The curvature for blades 405 may be in the same direction as the curvature for blades 403, e.g., to improve compression of refrigerant 205 within compressor 202.

Figure 4B:
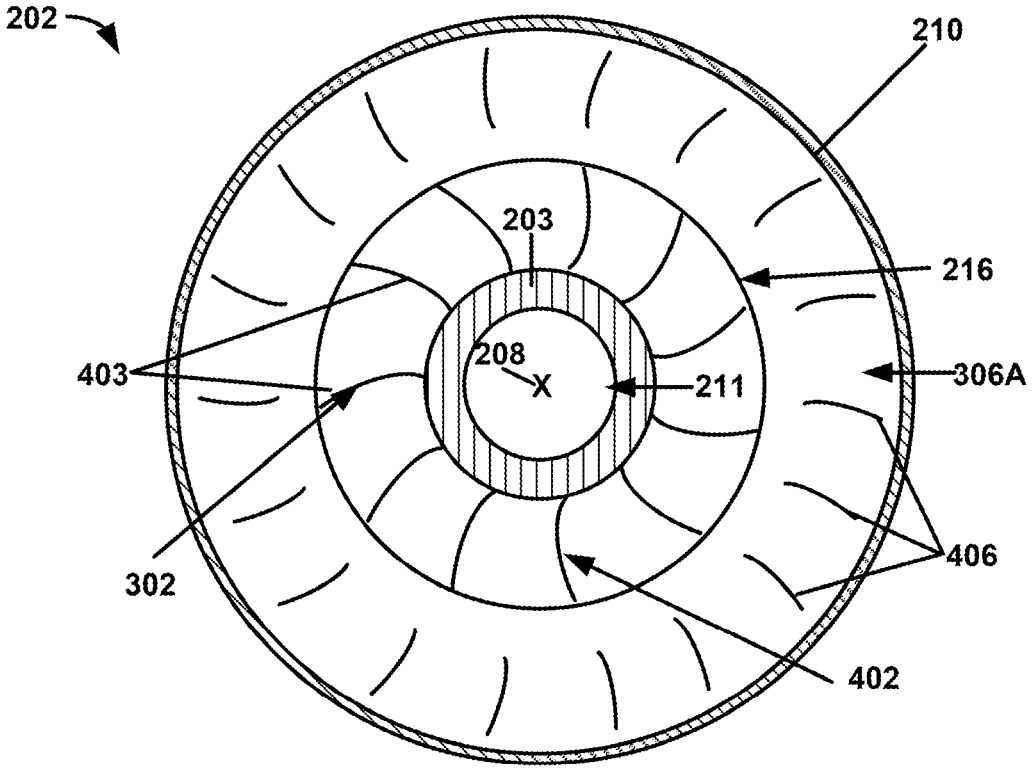
FIG. 4B is a conceptual diagram illustrating a cross-sectional view of the example centrifugal compressor of FIG. 2, the cross-section being take along line C-C of FIG. 3.

FIG. 4B is a conceptual diagram illustrating a cross-sectional view of the example centrifugal compressor 202 of FIG. 2, the cross-section being take along line C-C of FIG. 3. The cross-section of compressor 202 along line C-C illustrates cross-sections of first chamber 402, first impeller 302, and first diffuser 306A around outlet 218A of first compressor wheel 216. First diffuser 306A may include a plurality of vanes 406 distributed around a circumference of first diffuser 306A.

First chamber 402 may be fluidically coupled to first diffuser 306A and/or first diffuser 306A may be disposed at least partially within first chamber 402. At or around outlet 218A, refrigerant 205 exits from first chamber 402 and into first diffuser 306A. Rotation of first compressor wheel 216 about longitudinal axis 208 may cause blades 403 of first impeller 302 to impart kinetic energy to refrigerant 205 and increase the speed of refrigerant 205 travelling through first compressor wheel 216. When refrigerant 205 enters first diffuser 306A, vanes 406 of first diffuser 306A impedes flow of refrigerant 205 and reduces the speed of refrigerant 205. The reduction of speed of refrigerant 205 within first diffuser 306A increases the static pressure of refrigerant 205 (e.g., due to continuous flow of refrigerant 205 traveling at higher speeds into first diffuser 306A from within first chamber 402. Thus, refrigerant 205 exiting first diffuser 306A at outlet 218A may be at a higher pressure than refrigerant 205 entering first compressor wheel 216 at inlet 214A.

As illustrated in FIG. 4B, each of vanes 406 may define a curvature along a length of the vanes 406. The curvature of vanes 406 may be different from the curvature of blades 403 of first impeller 302. For example, vanes 406 and blades 403 may curve in different directions or define same or different radii of curvature. The curvature of vanes 406 increases resistance to the flow of refrigerant 205 through first diffuser 306A, thereby further reducing the speed of refrigerant 205 and increasing the pressure of refrigerant 205.

While not illustrated in FIG. 4B, second diffuser 306B of second compressor wheel 220 may increase the pressure of refrigerant 205 in a same manner as first diffuser 306A. For example, second diffuser 306B may include vanes configured to reduce the speed of refrigerant 205 within second diffuser 306B. The vanes of second diffuser 306B may define curvatures similar or different from curvatures of blades 405 of second impeller 308, e.g., to further reduce speed of refrigerant 205 within second diffuser 306B and increase the pressure of refrigerant 205 exiting second compressor wheel 220.

Figure 5A:
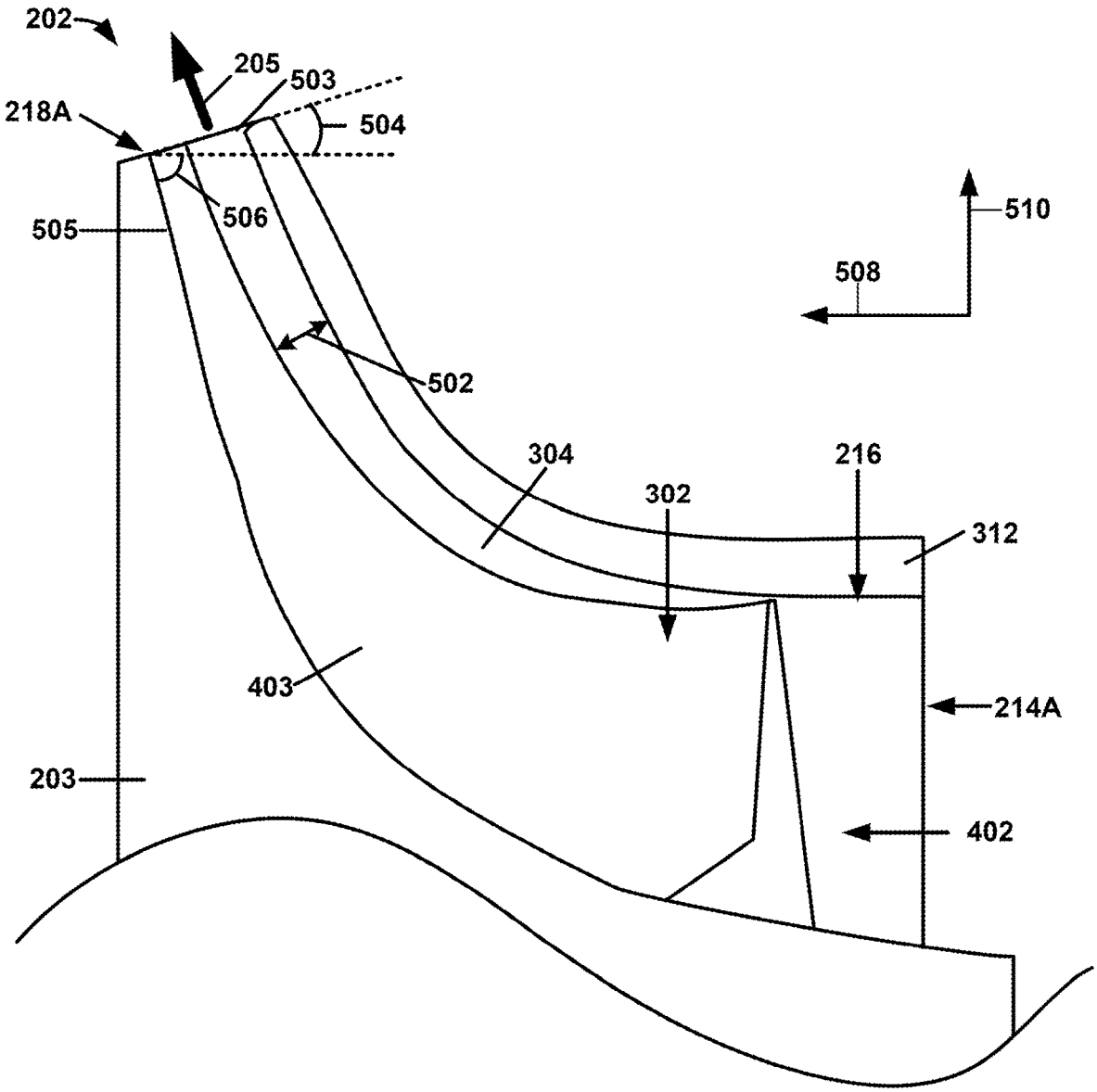
FIG. 5A is a perspective view diagram illustrating an example outlet of a first compressor of the example centrifugal compressor of FIG. 2.

FIG. 5A is a perspective view diagram illustrating an example outlet 218A of first compressor wheel 216 of the example centrifugal compressor 202 of FIG. 2. FIG. 5A illustrates first compressor wheel 216 as defining a mixed flow outlet (alternatively referred to herein as a "mixed flow exducer") at outlet 218A and including first impeller 302 with blades 403 with fillets 304 of varying widths 502 from inlet 214A towards outlet 218A. In other examples, first compressor wheel 216 may include the mixed flow outlet or fillets 304 with varying widths 502.

First chamber 402 may be shaped to output refrigerant 205 from outlet 218A at a mixed angle flow. Mixed angle flow of refrigerant 205 may include flow of refrigerant 205 out of first compressor wheel 216 in both an axial direction 508 (e.g., along longitudinal axis 208) and in a radial direction 510 (e.g., along a reference axis orthogonal to longitudinal axis 208). First compressor wheel 216 configured for mixed flow may compress refrigerant 205 at increased efficiency, may be simpler in design, and/or may retain a greater volume of refrigerant 205 compared to an identical compressor wheel configured to output refrigerant 205 only in axial direction 508 or radial direction 510. In some examples, first compressor wheel 216 configured for mixed flow may occupy a reduced volume compared to an identical compressor wheel configured to output refrigerant 205 in axial direction 508 or in radial direction 510 at a same pressure ratio.

Mixed flow exducer may cause outlet 218A to be offset from longitudinal axis 208 and/or a reference axis orthogonal to longitudinal axis 208 to cause first chamber 402 to output refrigerant 205 at a mixed angle. At outlet 218A, a radially-outward edge 503 of first compressor wheel 216 may be offset from longitudinal axis 208 by an angle 504 of up to about 45 degrees. At outlet 218A, a radially inner surface 505 of first chamber 402 may be offset from longitudinal axis 208 by an angle 506 of about up to about 60 degrees. Edge 503 may be orthogonal to inner surface 505, e.g., to facilitate flow of refrigerant 205 in a direction defined by edge 503 and inner surface 505.

Fillet 304 of each of blades 403 may vary in width 502 along the length of the respective blade 403. Width 502 of fillet 304 may be measured along an outer surface of the respective blade 403 extending from inner surface 505 of first chamber 402 to a radially-outward-most edge of the respective blade 403. Fillet 304 may increase in width 502 along the length of the respective blade 403 from inlet 214A towards outlet 218A. The increase in width 502 may facilitate flow of refrigerant 205 within first chamber 402 and/or reduce stress concentration on the outer surface and/or on a radially-outward-most edge of each blade 403. The increase in width 502 may be linear or non-linear. The increase in width 502 may be continuous or stepwise.

Figure 5B:
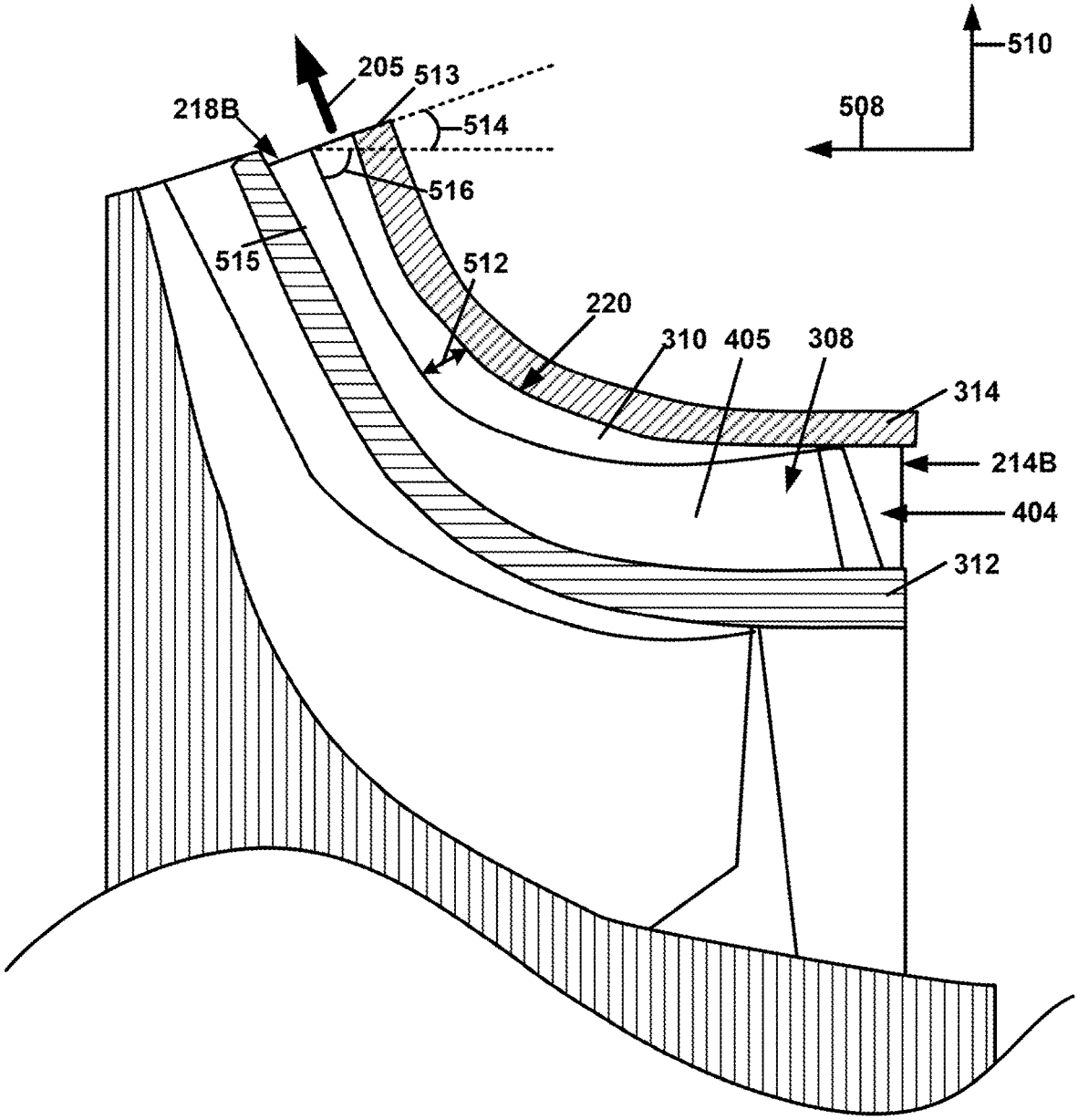
FIG. 5B is a perspective view diagram illustrating an example outlet of a second compressor of the example centrifugal compressor of FIG. 2.

FIG. 5B is a perspective view diagram illustrating an example outlet 218B of a second compressor wheel 220 of the example centrifugal compressor 202 of FIG. 2. FIG. 5B illustrates second compressor wheel 220 as defining a mixed flow exducer at outlet 218B and including second impeller 308 with blades 405 with fillets 310 of varying widths 512 from inlet 214B towards outlet 218B. In other examples, second compressor wheel 220 may include the mixed flow exducer or fillets 310 with varying widths 512.

Second chamber 404 may be shaped to output refrigerant 205 from outlet 218B at a mixed angle flow, e.g., to form a mixed flow exducer. Mixed angle flow of refrigerant 205 may include flow of refrigerant 205 out of second compressor wheel 20 in both axial direction 508 and radial direction 510. Second compressor wheel 220 may output refrigerant 205 at a same or different angle as first compressor wheel 216.

Outlet 218B may be offset from longitudinal axis 208 and/or a reference axis orthogonal to longitudinal axis 208 to cause second chamber 404 to output refrigerant 205 at a mixed angle, e.g., to form a mixed flow exducer. At outlet 218B, a radially outward edge 513 of second compressor wheel 220 may be offset from longitudinal axis 208 by an angle 514 of about up to about 45 degrees. At outlet 218B, a radially inner surface 515 of second chamber 404 may be offset from longitudinal axis 208 by an angle 516 of up to about 60 degrees. Angle 514 may be the same as or different from angle 504. Angle 516 may be the same as or different from angle 506. Edge 513 may be orthogonal to inner surface 515, e.g., to facilitate flow of refrigerant 205 in a direction defined by edge 513 and inner surface 515.

Fillet 310 of each of blades 405 may vary in width 512 along the length of the respective blade 405. Width 512 of fillet 310 may be measured along an outer surface of the respective blade 405 extending from inner surface 515 of second chamber 404 to a radially-outward-most edge of the respective blade 405. Fillet 310 may increase in width 512 along the length of the respective blade 405 from inlet 214B towards outlet 218B. The increase in width 512 may facilitate flow of refrigerant 205 within second chamber 404 and/or reduce stress concentration on the outer surface and/or on a radially-outward-most edge of each blade 405. The increase in width 512 may be linear or non-linear. The increase in width 512 may be continuous or stepwise.

Width 502 may be the same or different from width 512. A change in width 502 (e.g., an increase in width 502) may be the same as or different from a change in width 512. For example, at any point along blade 403, width 502 of fillet 304 may be the same as or different from width 512 of fillet 310, e.g., at a same location along longitudinal axis 208.

Figure 6:
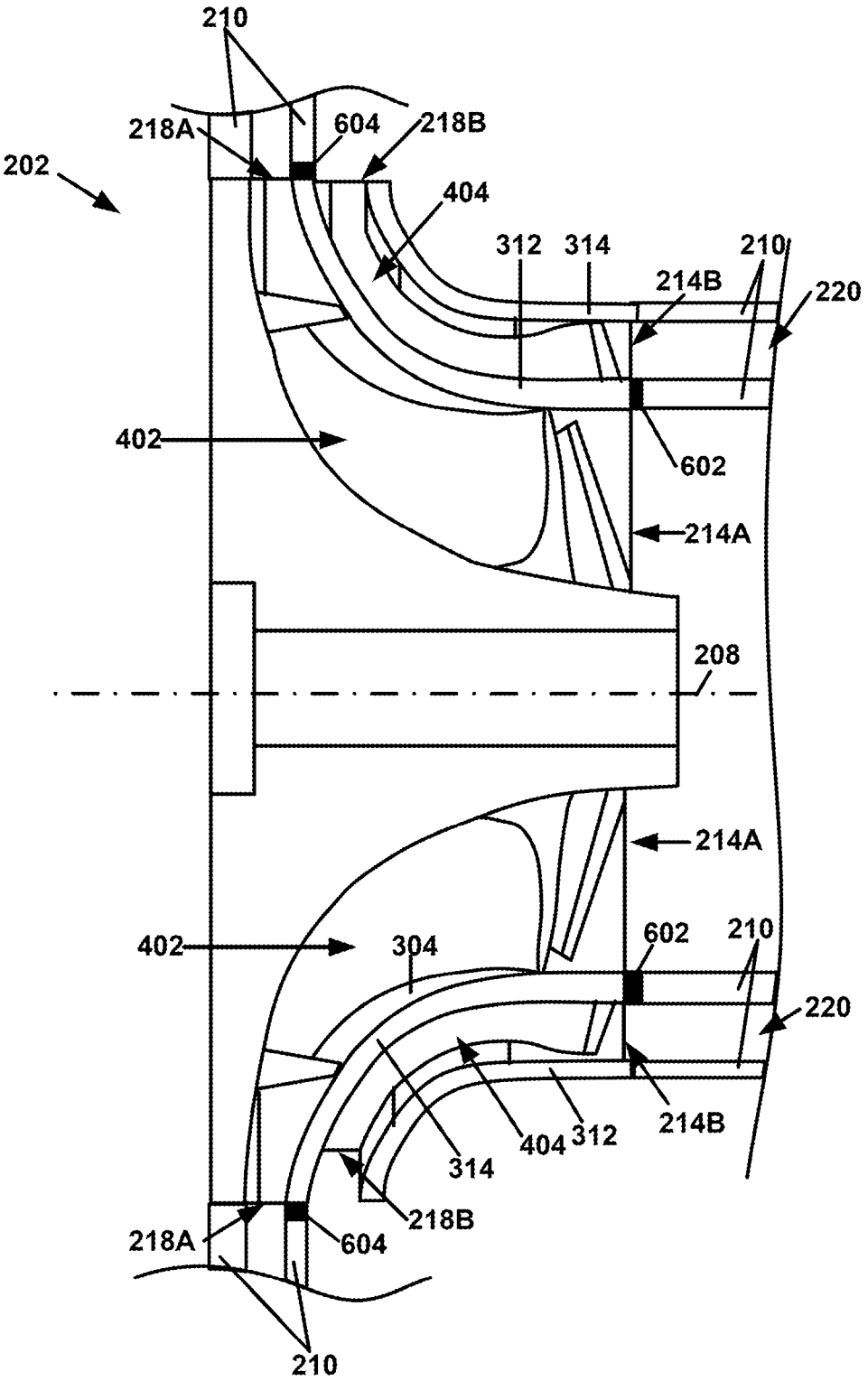
FIG. 6 is a perspective view diagram illustrating another example view of the centrifugal compressor of FIG. 2.

FIG. 6 is a perspective view diagram illustrating another example view of the centrifugal compressor 202 of FIG. 2. As illustrated in FIG. 6, seal(s) 602 and/or seal(s) 604 may be disposed around and between inlets 214A, 214B and/or outlets 218A, 218B, respectively. Seals 602, 604 may inhibit flow or refrigerant 205 between first chamber 402 of first compressor wheel 216 and second chamber 404 of second compressor wheel 220, thereby maintaining the pressure ratio of refrigerant 205 outputted by compressor 202.

One or more seals 602 may be disposed between first chamber 402 and second chamber 404 at a first end of compressor 202. Seal(s) 602 may be disposed between and fluidically isolate inlets 214A and 214B, e.g., to inhibit unintended flow of refrigerant 205 from first chamber 402 into second chamber 404, or vice versa. For example, seals(s) 602 inhibit flow of less pressurized refrigerant 205 entering inlet 214A from mixing with more pressurized refrigerant 205 entering inlet 214B as compressor 202 rotates about longitudinal axis 208. In some examples, compressor 202 may include a single seal 602 disposed along a first edge of wall 312 and around an entire circumference of compressor 202, e.g., such that seal 602 forms an O-ring. In some examples, two or more seals 602 may be disposed along the first edge of wall 312. Together, the two or more seals 602 may extend around the circumference of compressor 202, e.g., such that the two or more seals 602 form an O-ring. Seal(s) 602 may be attached to wall 312 of compressor 202 and may rotate about longitudinal axis 208 in conjunction with compressor 202. In some examples, seals(s) 602 are attached to a portion of housing 210 in apposition with wall 312 of compressor 202 and seal(s) 602 may remain stationary as compressor 202 rotates about longitudinal axis 208. Seal(s) 602 may include, but are not limited to, carbon seals, _____.

One or more seals 604 may be disposed between first chamber 402 and second chamber 404 at a first end of compressor 202. Seal(s) 602 may be disposed between and fluidically isolate inlets 214A and 214B, e.g., to inhibit unintended flow of refrigerant 205 from first chamber 402 into second chamber 404, or vice versa. For example, seal(s) 604 inhibit mix of less pressurized refrigerant 205 exiting first chamber 402 with more pressurized refrigerant 205 exiting second chamber 404. In some examples, compressor 202 may include a single seal 604 disposed along a first edge of wall 312 and around an entire circumference of compressor 202, e.g., such that seal 604 forms an O-ring. In some examples, two or more seals 604 may be disposed along the first edge of wall 312. Together, the two or more seals 604 may extend around the circumference of compressor 202, e.g., such that the two or more seals 604 form an O-ring. Seal(s) 604 may be attached to wall 312 of compressor 202 and may rotate about longitudinal axis 208 in conjunction with compressor 202. In some examples, seals(s) 604 are attached to a portion of housing 210 in apposition with wall 312 of compressor 202 and seal(s) 602 may remain stationary as compressor 202 rotates about longitudinal axis 208. In some examples, where diffusers 306A, 306B are disposed within compressor 202, seal(s) 604 are disposed radially outside of diffusers 306A, 306B. In some examples, where diffusers 306A, 306B are disposed within housing 210, seal(s) 604 are disposed radially between compressor 202 and diffusers 306A, 306B. Seal(s) 604 may define same or different dimensions (e.g., cross-sectional length, cross-sectional width) as seal(s) 602. Seal(s) 604 may be formed from the same or different materials as seal(s) 602. Seal(s) 604 may include, but are not limited to, carbon seals, labyrinth seals, feather seals, or the like.

FIG. 3-6 illustrate different example components of compressor 202. The example components include, but are not limited to: variable fillet 304, 310 on blades 403, 405; shrouded second impeller 308; curvature of blades 403, 405;

curvature of vanes (e.g., vanes 406) of diffusers 306A, 306B; mixed flow exducers at outlets 218A, 218; seal(s) 602, 604; or the like. Examples of compressor 202 described herein may include any combination of the example components listed above. For example, compressor 202 may include shrouded second impeller 308 and variable fillets 304, 310, may include seal(s) 602, 604, mixed flow exducers, and curved vanes 406, or may include any other combination of one or more of the example components listed above.

In some examples, the disclosure describes a compressor 202 comprising: a first compressor wheel 216 comprising: a first chamber 402 configured to retain a medium (e.g., refrigerant 205); a first impeller 302 disposed within first chamber 402, wherein first impeller 302 is configured to revolve around longitudinal axis 208 of compressor 202 and within first chamber 402, and wherein the first impeller 302 comprises a plurality of blades 403; and a first diffuser 306A fluidically connected to first chamber 402 and configured to output the medium from first chamber 402; and a second compressor wheel 220 comprising: a second chamber 404 disposed radially outwards of first chamber 402 relative to longitudinal axis 208, wherein second chamber 404 is separated from first chamber 402 by an outer wall 312 of first chamber 402, and wherein second chamber 404 is configured to receive the outputted medium from first chamber 402; a second impeller 308 disposed within second chamber 404, wherein second impeller 308 is configured to revolve around longitudinal axis 208 of compressor 202 within second chamber 404; and a second diffuser 306B fluidically connected to second chamber 404, wherein second diffuser 306B is configured output the medium from second chamber 404, wherein each blade 403 of the plurality of blades 403 defines a fillet 304 extending along a radially outward-most edge of the respective blade 403, and wherein a width 502 of the fillet 304 along a surface of the respective blade 403 varies along longitudinal axis 208.

In another example, the disclosure describes a compressor 202 comprising: a first compressor wheel 216 comprising: a first chamber 402 configured to retain a medium (e.g., refrigerant 205); a first impeller 302 disposed within first chamber 402, wherein first impeller 302 is configured to revolve around a longitudinal axis 208 of compressor 202 and within first chamber 402; and a first diffuser 306A fluidically connected to first chamber 402, wherein first diffuser 306A is configured to output the medium from first chamber 402; and a second compressor wheel 220 comprising: a second chamber 404 disposed radially outwards of first chamber 402 relative to longitudinal axis 208, wherein second chamber 404 is separated from first chamber 402 by a first outer wall 312, wherein second chamber 404 is configured to receive the outputted medium from first chamber 402, and wherein second chamber 404 comprises a second outer wall 314 radially outwards of the first outer wall 312; a second impeller 308 disposed within second chamber 404 and radially inwards of the second outer wall 314, wherein second impeller 308 is configured to revolve around longitudinal axis 208 within second chamber 404; and a second diffuser 306B fluidically connected to the second chamber 404, wherein second diffuser 306B is configured output the medium from second chamber 404, wherein second outer wall 314 shrouds second chamber 404 from a first opening (e.g., inlet 214B) of second chamber 404 to a second opening (e.g., outlet 218B) of second chamber 404 and around an outer circumference of second chamber 404.

Figure 7:
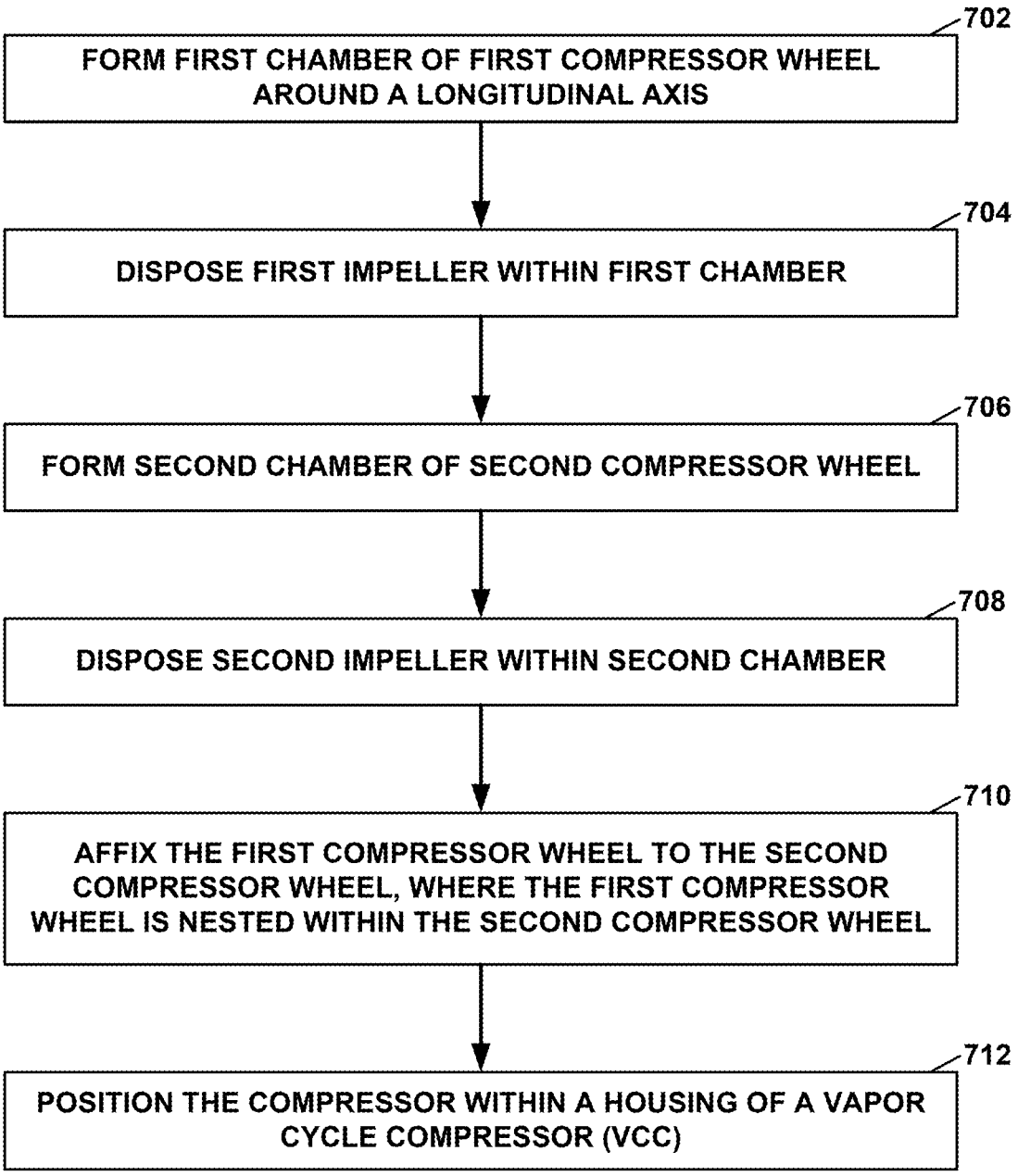
FIG. 7 is a flow diagram illustrating an example process of manufacturing an example compressor.

FIG. 7 is a flow diagram illustrating an example process of manufacturing an example compressor 202 of VCC 112. While FIG. 7 illustrates a process for manufacturing compressor 202 including two compressor wheels (i.e., first compressor wheel 216, second compressor wheel 220), the process may be applied to form compressor 202 with three or more compressor wheels.

A manufacturing system may form first chamber 402 of first compressor wheel 216 around longitudinal axis 208 (702). The manufacturing system may form compressor body 203 around longitudinal axis 208. Compressor body 203 may define channel 211 extending from a first end of compressor body 203 to a second end of compressor body 203. Channel 211 may be sized to receive and/or retain drive shaft 212 connecting compressor 202 to a motor of VCC 112. The manufacturing system may form and/or affix walls defining first chamber to compressor body 203, e.g., such that first chamber 402 is defined radially outwards of compressor body 203. The manufacturing system may form the walls directly onto a surface of compressor body 203, e.g., via additive manufacturing. In some examples, the manufacturing system forms the walls separately and subsequently affixes the walls to the surface of compressor body 203, e.g., via welding, fixation mechanisms, or application of an adhesive. The walls may define the internal dimensions of first chamber 402. First chamber 402 may not be fully enclosed, e.g., to facilitate insertion and/or manufacture of first impeller 302 in first chamber 402.

The manufacturing system may form walls of first chamber 402 to define an inlet 214A and an outlet 218A. In some examples, the manufacturing system may shape first chamber 402 to include a mixed flow exducer, e.g., such that outlet 218A extends in both a longitudinal direction 508 along longitudinal axis 208 and in a radial direction 510.

The manufacturing system may dispose first impeller 302 within first chamber 402 (704). First impeller 302 may be disposed within first chamber 402 and may extend from a radially-inward-most surface of first chamber 402 towards or to a radially-outward-most surface of first chamber 402. In some examples, the manufacturing system forms blades 403 of first impeller 302 directly within first chamber 402. For example, the manufacturing system may form blades 403 directly onto a surface of first chamber 402, e.g., an outer surface of compressor body 203. In some examples, the manufacturing system forms blades 403 separately and affixes blades 403 to one or more surfaces of first chamber 402 (e.g., to the outer surface of compressor body 203) via welding, one or more fixation features, an adhesive, or the like. The manufacturing system may form each blade 403 to define a fillet 304 along a radially-outward-most edge of the blade 403. Fillet 304 may define a constant width 502 or may define a varying width 502 along the length of the blade.

In some examples, the manufacturing system may form and/or affix vanes 406 of diffuser 306A into first chamber 402, e.g., at a position downstream of first impeller 302. The manufacturing system may form and/or affix vanes 406 in a similar manner as blades 403 of first impeller 302. For example, the manufacturing system may form vanes 406 and/or blades 403 via an additive manufacturing technique.

After first impeller 302 is disposed within and affixed to one or more surfaces of first chamber 402, the manufacturing system may form and/or affix wall 312 to first chamber 402, e.g., to fully enclose first chamber 402 around a circumference of first compressor wheel. First chamber 402 may define inlet 214A and outlet 218A to allow for flow of refrigerant 205 through first chamber 402.

The manufacturing system may form second chamber 404 of second compressor wheel 220 (706). The manufacturing system may form second chamber 404 into a torus shape.

Second chamber 404 may a recess radially inwards of an inner wall (e.g., wall 312) of second chamber 404. The recess may be sized to retain first compressor wheel 216 at a same longitudinal position as second chamber 404 and allow first compressor wheel 216 to be nested within second chamber 404. The manufacturing system may form second chamber 404 in a same or similar process as first chamber 402. In some examples, the manufacturing system may define second chamber 404 to include a mixed flow exducer.

The manufacturing system may dispose second impeller 308 within second chamber 404 (708). The manufacturing system may dispose second impeller 308 within second chamber 404 in a same or similar process as first impeller 302 within first chamber 402. Blades 405 of second impeller 308 may define similar or different dimensions as blades 403 of first impeller 302. Blades 405 may define fillets 310 of same or different widths 512 as widths 502 of blades 403. In some examples, after disposing blades 405 within second chamber 404, the manufacturing system may form wall 314 radially outward of second impeller 308 to enclose second chamber 404 around a circumference of second compressor wheel 220 and/or to shroud second impeller 308. Second chamber 404 may define inlet 214B and outlet 218B to allow for flow of refrigerant 205 through second chamber 404.

In some examples, the manufacturing system forms and/or disposes vanes of diffuser 306B within second chamber 404. The vanes may be disposed downstream of blades 405 of second impeller 308. The manufacturing system may form the vanes in accordance with the process described above with respect to diffuser 306A of first compressor wheel 216.

The manufacturing system may affix first compressor wheel 216 to second compressor wheel 220, wherein first compressor wheel 216 is nested within second compressor wheel 220 (710). First compressor wheel 216 and second compressor wheel 220 may be separate components. First compressor wheel 216 may define a same or shorter length along longitudinal axis 208 as second compressor wheel 220. First compressor wheel 216 may define a smaller radius than second compressor wheel 220. First compressor wheel 216 may be sized to be at least partially nested within the recess defined by second compressor wheel 220. The manufacturing system may affix first compressor wheel 216 to second compressor wheel 220 via welding, one or more fixation features (e.g., screws, bolts, clips, or the like), one or more adhesives, or the like. When first compressor wheel 216 is affixed to second compressor wheel 220, rotation of first compressor wheel 216 about longitudinal axis 208 causes second compressor wheel 220 to rotate about longitudinal axis 208. An outer wall 312 of first chamber 402 and an inner wall 312 of second chamber 404 may be affixed to form a single wall 312 separating first chamber 402 from second chamber 404.

The manufacturing system may position compressor 202 within housing 210 of VCC 112 (712) Housing 210 may direct refrigerant 205 into compressor 202, between compressor wheels of compressor 202, and away from compressor 202. Housing may extend around compressor 202 and may define one or more channels 221 linking compressor wheels. The manufacturing system may position compressor 202 within at least a portion of housing 210 and form the remainder of housing 210 around compressor 202. For example, housing 210 may be formed from multiple components and the manufacturing system may connected the multiple components around compressor 202 to form a single, continuous housing 210. Together, housing 210 and compressor 202 may define VCC 112 of system 100, as illustrated in FIG. 1. In some examples, housing 210 may be disassembled and reassembled, e.g., to facilitate maintenance and replacement of components of VCC 112.

Figure 8:
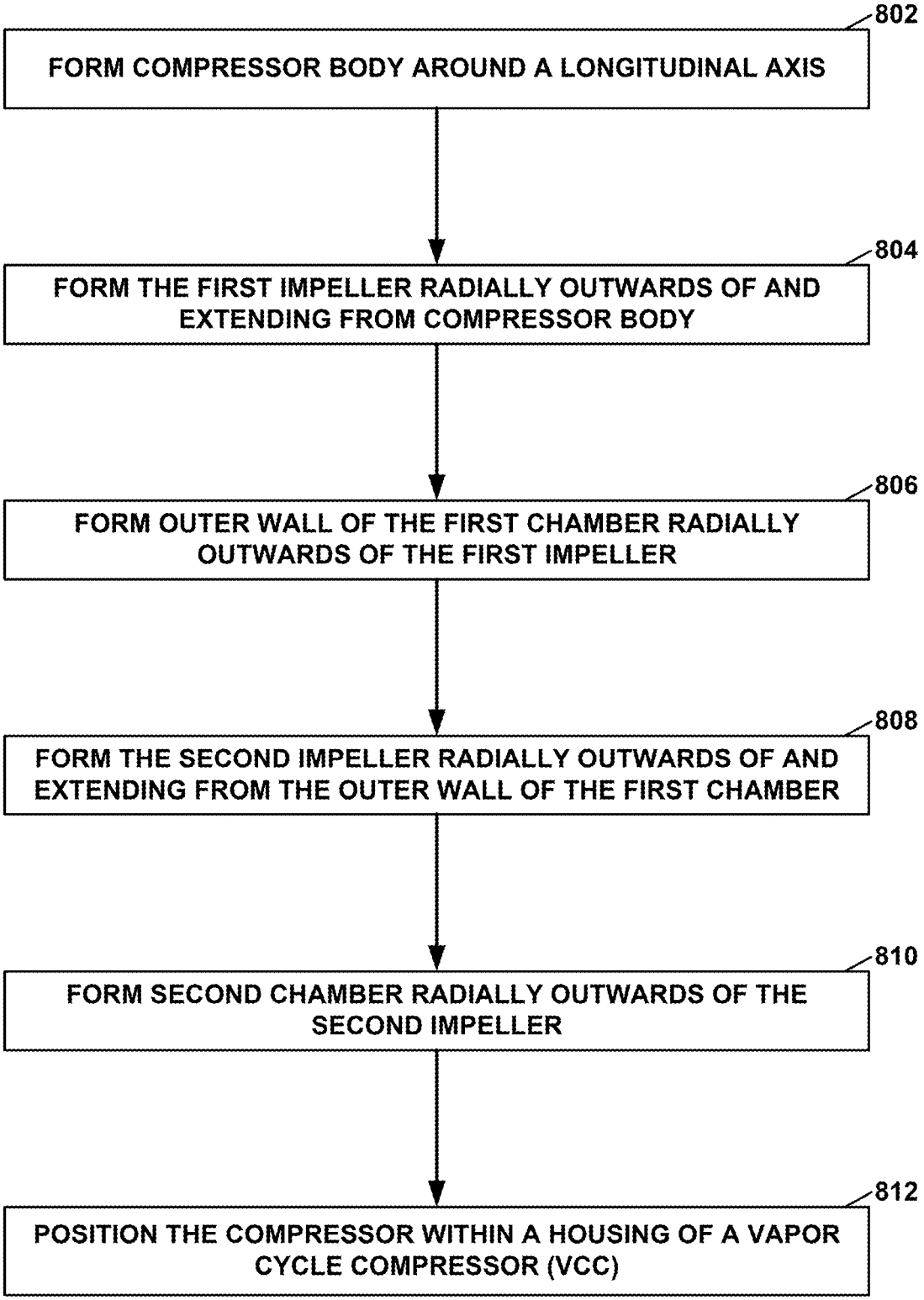
FIG. 8 is a flow diagram illustrating another example process of manufacturing an example compressor.

FIG. 8 is a flow diagram illustrating another example process of manufacturing an example compressor 202 of VCC 112. While FIG. 8 illustrates a process for manufacturing compressor 202 including two compressor wheels (i.e., first compressor wheel 216, second compressor wheel 220), the process may be applied to form compressor 202 with three or more compressor wheels. As compared to the example process illustrated in FIG. 7, FIG. 8 illustrates an example method of manufacturing compressor 202 as a single component.

A manufacturing system may form compressor body 203 around a longitudinal axis 208 (802). The manufacturing system may form compressor body 203 via one or more techniques including, but are not limited to, molding or additive manufacturing. The manufacturing system may form compressor body 203 to include channel 211 or may form channel 211 within compressor body 203 after forming compressor body 203. Channel 211 may be configured to receive and/or retain drive shaft 212 connecting compressor 202 to a motor of VCC 112.

The manufacturing system may form first impeller 302 radially outwards of an extending from compressor body 203 (804). In some examples, the manufacturing system forms blades 403 of first impeller 302 separately and affixes blades 403 to outer surface of compressor body 203 to form first impeller 302. In some examples, the manufacturing system forms blades 403 directly on the outer surface of compressor body 203, e.g., via additive manufacturing. Each of blades 403 may define a fillet 304 along a radially-outward-most edge of each blade 403. Fillet 304 may define a variable width 502 (e.g., an increasing width 502) along the length of each blade 403. Each of blades 403 may define a curvature across the cross-section of each blade 403. The curvature may vary along the length of each blade 403.

The manufacturing system may form outer wall 312 of first chamber 402 radially outwards of first impeller 302 (806). Outer wall 312 and surface of compressor body 203 may define first chamber 402 of first compressor wheel 216. Outer wall 312 may fluidically isolate first compressor wheel 216 from second compressor wheel 220. In some examples, outer wall 312 may be affixed to the radially-outward-most edge of each blade 403. In some examples outer wall 312 may be connected to compressor body 203 at around inlet 214A and outlet 218A of first compressor wheel 216 and may not be affixed to any of blades 403 within first chamber 402.

The manufacturing system may form second impeller 308 radially outwards of an extending from outer wall 312 of first chamber 402 (808). Wall 312 may define an outer wall of first chamber 402 and an inner wall of second chamber 404 of second compressor wheel 220. The manufacturing system may form blades 405 of second impeller 308 separately and affix blades 405 to wall 312. In some examples, the manufacturing system may form blades 405 directly on a radially outward surface of wall 312, e.g., via additive manufacturing. Each of blades 405 may define a fillet 310 along a radially-outward-most edge of each blade 405. Fillet 304 may define a variable width 512 (e.g., an increasing width 512) along the length of each blade 405. Each of blades 405 may define a curvature across the cross-section of each blade 405. The curvature may vary along the length of each blade 405.

The manufacturing system may form second chamber 404 radially outwards of second impeller 308 (810). In some examples, such as when second impeller 308 is shrouded, the manufacturing system forms wall 314 radially outwards of and connected to blades 405 of second impeller 308. Wall 314 may enclose second chamber 404 around the circumference of compressor 202 from inlet 214B to outlet 218B. In some examples, where second impeller 308 is not shrouded, second chamber 404 may be at least partially defined by a wall of housing 210 radially outward of second impeller 308.

The manufacturing system may position compressor 202 within housing 210 of VCC 112 (812) Housing 210 may direct refrigerant 205 into compressor 202, between compressor wheels of compressor 202, and away from compressor 202. Housing may extend around compressor 202 and may define one or more channels 221 linking compressor wheels. The manufacturing system may position compressor 202 within at least a portion of housing 210 and form the remainder of housing 210 around compressor 202. For example, housing 210 may be formed from multiple components and the manufacturing system may connected the multiple components around compressor 202 to form a single, continuous housing 210. Together, housing 210 and compressor 202 may define VCC 112 of system 100, as illustrated in FIG. 1. In some examples, housing 210 may be disassembled and reassembled, e.g., to facilitate maintenance and replacement of components of VCC 112.

A "vehicle" may be an aircraft, a land vehicle such as an automobile, or a water vehicle such as a ship or a submarine. An "aircraft" as described and claimed herein may include any fixed-wing or rotary-wing aircraft, airship (e.g., dirigible or blimp buoyed by helium or other lighter-than-air gas), suborbital spaceplane, spacecraft, expendable or reusable launch vehicle or launch vehicle stage, or other type of flying device. An "aircraft" as described and claimed herein may include any crewed or uncrewed craft (e.g., uncrewed aerial vehicle (UAV), flying robot, or automated cargo or parcel delivery drone or other craft).

The following examples may illustrate one or more of the techniques of this disclosure.

Example 1: a compressor comprising: a first compressor wheel comprising: a first chamber configured to retain a medium; a first impeller disposed within the first chamber, wherein the first impeller is configured to revolve around a longitudinal axis of the compressor and within the first chamber, and wherein the first impeller comprises a plurality of blades; and a first diffuser fluidically connected to the first chamber and configured to output the medium from the first chamber; and a second compressor wheel comprising: a second chamber disposed radially outwards of the first chamber relative to the longitudinal axis, wherein the second chamber is separated from the first chamber by an outer wall of the first chamber, and wherein the second chamber is configured to receive the outputted medium from the first chamber; a second impeller disposed within the second chamber, wherein the second impeller is configured to revolve around the longitudinal axis of the compressor within the second chamber; and a second diffuser fluidically connected to the second chamber, wherein the second diffuser is configured output the medium from the second chamber, wherein each blade of the plurality of blades defines a fillet extending along a radially outward-most edge of the respective blade, and wherein a width of the fillet along a surface of the respective blade varies along the longitudinal axis.

Example 2: the compressor of example 1, wherein the first chamber extends from a proximal opening to a distal opening along the longitudinal axis, wherein the first diffuser is coupled to the distal opening, and wherein the width increases from a first end of the first diffuser at the proximal opening of the first chamber to a second end of the first diffuser at the distal opening of the first chamber.

Example 3: the compressor of any of examples 1 and 2, wherein the plurality of blades comprises first plurality of blades, wherein the fillet comprises a first fillet, wherein the width comprises a first width, wherein the second impeller comprises a second plurality of blades, and wherein each blade of the second plurality of blades defines a second fillet extending along a radially outward-most edge of the respective blade, and wherein a second width of the second fillet along a surface of the respective blade varies along the longitudinal axis.

Example 4: the compressor of example 3, wherein the second chamber extends from a proximal opening to a distal opening along the longitudinal axis, wherein the second diffuser is coupled to the distal opening, and wherein the second width increases from a first end of the second diffuser at the proximal opening of the second chamber to a second end of the second diffuser at the distal opening of the second chamber.

Example 5: the compressor of any of examples 3 and 4, wherein at one or more longitudinal positions along the longitudinal axis, the first width is different from the second width.

Example 6: the compressor of any of examples 1-5, wherein the first diffuser comprises a plurality of vanes disposed around a circumference of the first diffuser.

Example 7: the compressor of example 6, wherein each blade of the plurality of blades defines a curvature in a first direction along a reference plane orthogonal to the longitudinal axis, and wherein each vane of the plurality of vanes defines a curvature in a second direction along the reference plane, wherein the first direction is different from the second direction.

Example 8: the compressor of any of examples 1-7, wherein the outer wall of the first chamber comprises a first outer wall, wherein the second chamber comprises a second outer wall disposed radially outwards of the second impeller, wherein the second outer wall shrouds the second chamber from a proximal opening of the second chamber to a distal opening of the second chamber and around a circumference of the second chamber.

Example 9: the compressor of example 8, wherein the second outer wall is affixed to the second impeller.

Example 10: the compressor of any of examples 1-9, wherein one or more of the first impeller or the second impeller comprises a mixed-flow impeller, wherein when the medium exits one or more of the first chamber or the second chamber containing the mixed-flow impeller, the mixed-flow impeller is configured to cause the medium to flow axially and radially relative to the longitudinal axis.

Example 11: the compressor of any of examples 1-10, wherein the compressor comprises one or more seals disposed at one or more of: a proximal end of the outer wall of the first chamber between the first chamber and the second chamber; or a distal end of the outer wall of the first chamber between the first chamber and the second chamber, wherein the one or more seals are configured to inhibit flow of the medium between the first chamber and the second chamber.

Example 12: the compressor of example 11, wherein the one or more seals comprises one or more carbon seals.

Example 13: the compressor of any of examples 1-12, wherein the compressor is configured to be manufactured via additive manufacturing.

Example 14: the compressor of any of examples 1-13, further comprising a compressor body radially inwards of the first compressor wheel, wherein the compressor body defines an inner lumen configured to receive a drive shaft, and wherein the compressor is configured to rotate about the longitudinal axis in response to rotation of the drive shaft.

Example 15: the compressor of any of examples 1-14, further comprising a housing disposed radially outwards of the second compressor wheel, wherein the housing defines one or more channels configured to direct the medium from the first compressor wheel into the second compressor wheel.

Example 16: the compressor of example 15, wherein the housing defines an outlet configured to direct the medium away from the second compressor wheel along a reference axis different from the longitudinal axis.

Example 17: a compressor comprising: a first compressor wheel comprising: a first chamber configured to retain a medium; a first impeller disposed within the first chamber, wherein the first impeller is configured to revolve around a longitudinal axis of the compressor and within the first chamber; and a first diffuser fluidically connected to the first chamber, wherein the first diffuser is configured to output the medium from the first chamber; and a second compressor wheel comprising: a second chamber disposed radially outwards of the first chamber relative to the longitudinal axis, wherein the second chamber is separated from the first chamber by a first outer wall, wherein the second chamber is configured to receive the outputted medium from the first chamber, and wherein the second chamber comprises a second outer wall radially outwards of the first outer wall; a second impeller disposed within the second chamber and radially inwards of the second outer wall, wherein the second impeller is configured to revolve around the longitudinal axis within the second chamber; and a second diffuser fluidically connected to the second chamber, wherein the second diffuser is configured output the medium from the second chamber, wherein the second outer wall shrouds the second chamber from a first opening of the second chamber to a second opening of the second chamber and around an outer circumference of the second chamber.

Example 18: the compressor of example 17, wherein the second impeller comprises a plurality of blades, and wherein each blade of the plurality of blades is affixed to at least one of the first outer wall or the second outer wall.

Example 19: the compressor of any of examples 17 and 18, wherein the first impeller comprises a plurality of blades, wherein each blade of the plurality of blades defines a fillet extending along a radially outward-most edge of the respective blade, and wherein a width of the fillet along a surface of the respective blade varies along the longitudinal axis.

Example 20: the compressor of example 19, wherein the first chamber extends from a proximal opening to a distal opening along the longitudinal axis, wherein the first diffuser is coupled to the distal opening, and wherein the width increases from a first end of the first diffuser at the proximal opening of the first chamber to a second end of the first diffuser at the distal opening of the first chamber.

Example 21: the compressor of any of examples 19 and 20, wherein the plurality of blades comprises first plurality of blades, wherein the fillet comprises a first fillet, wherein the width comprises a first width, wherein the second impeller comprises a second plurality of blades, and wherein each blade of the second plurality of blades defines a second fillet extending along a radially outward-most edge of the respective blade, and wherein a second width of the second fillet along a surface of the respective blade varies along the longitudinal axis.

Example 22: the compressor of example 21, wherein the second width increases from a first end of the second diffuser at the proximal opening of the second chamber to a second end of the second diffuser at the distal opening of the second chamber.

Example 23: the compressor of any of examples 21 and 22, wherein at one or more longitudinal positions along the longitudinal axis, the first width is different from the second width.

Example 24: the compressor of any of examples 17-23, wherein the first diffuser comprises a plurality of vanes disposed around a circumference of the first diffuser.

Example 25: the compressor of example 24, wherein the first impeller comprises a plurality of blades, each blade of the plurality of blades defining a curvature in a first direction along a reference plane orthogonal to the longitudinal axis, and wherein each vane of the plurality of vanes defines a curvature in a second direction along the reference plane, wherein the first direction is different from the second direction.

Example 26: the compressor of any of examples 17-25, wherein one or more of the first impeller or the second impeller comprises a mixed-flow impeller, wherein when the medium exits one or more of the first chamber or the second chamber containing the mixed-flow impeller, the mixed-flow impeller is configured to cause the medium to flow axially and radially relative to the longitudinal axis.

Example 27: the compressor of any of examples 17-26, wherein the compressor comprises one or more seals disposed at one or more of: a proximal end of the first outer wall between the first chamber and the second chamber; or a distal end of the first outer wall between the first chamber and the second chamber, wherein the one or more seals are configured to inhibit flow of the medium between the first chamber and the second chamber.

Example 28: the compressor of example 27, wherein the one or more seals comprises one or more carbon seals.

Example 29: the compressor of any of examples 17-28, wherein the compressor is configured to be manufactured via additive manufacturing.

Example 30: the compressor of any of examples 17-29, further comprising a compressor body radially inwards of the first compressor wheel, wherein the compressor body defines an inner lumen configured to receive a drive shaft, and wherein the compressor is configured to rotate about the longitudinal axis in response to rotation of the drive shaft.

Example 31: the compressor of any of examples 17-30, further comprising a housing disposed radially outwards of the second compressor wheel, wherein the housing defines one or more channels configured to direct the medium from the first compressor wheel into the second compressor wheel.

Example 32: the compressor of example 31, wherein the housing defines an outlet configured to direct the medium away from the second compressor wheel along a reference axis different from the longitudinal axis.

Example 33: a method of manufacturing the compressor of any of examples 1-32, the method comprising: forming the first chamber around the longitudinal axis; disposing the first impeller within the first chamber; affixing the first diffuser to the first chamber; disposing the second chamber radially outwards of the first chamber relative to the longitudinal axis; disposing the second impeller within the second chamber; and affixing the second diffuser to the second chamber.

Example 34: the method of example 33, wherein disposing the first impeller within the first chamber comprises: forming the first impeller within the first chamber; and enclosing the first impeller within the first chamber.

Example 35: the method of any of examples 33 and 34, wherein disposing the second impeller within the second chamber comprises: forming the second impeller within the second chamber; and enclosing the second impeller within the second chamber.

What is claimed is:

1. A compressor comprising:

a first compressor wheel comprising:

a first chamber configured to retain a medium;

a first impeller disposed within the first chamber, wherein the first impeller is configured to revolve around a longitudinal axis of the compressor and within the first chamber, and wherein the first impeller comprises a plurality of blades; and a first diffuser fluidically connected to the first chamber and configured to output the medium from the first chamber; and a second compressor wheel comprising:

a second chamber disposed radially outwards of the first chamber relative to the longitudinal axis, wherein the second chamber is separated from the first chamber by an outer wall of the first chamber, and wherein the second chamber is configured to receive the outputted medium from the first chamber;

a second impeller disposed within the second chamber, wherein the second impeller is configured to revolve around the longitudinal axis of the compressor within the second chamber; and a second diffuser fluidically connected to the second chamber, wherein the second diffuser is configured output the medium from the second chamber, wherein each blade of the plurality of blades defines a fillet extending along a radially outward-most edge of the respective blade, and wherein a width of the fillet along a surface of the respective blade varies along the longitudinal axis.

2. The compressor of claim 1, wherein the first chamber extends from a proximal opening to a distal opening along the longitudinal axis, wherein the first diffuser is coupled to the distal opening, and wherein the width increases from a first end of the first diffuser at the proximal opening of the first chamber to a second end of the first diffuser at the distal opening of the first chamber.

3. The compressor of claim 1, wherein the plurality of blades comprises first plurality of blades, wherein the fillet comprises a first fillet, wherein the width comprises a first width, wherein the second impeller comprises a second plurality of blades, and wherein each blade of the second plurality of blades defines a second fillet extending along a radially outward-most edge of the respective blade, and wherein a second width of the second fillet along a surface of the respective blade varies along the longitudinal axis.

4. The compressor of claim 3, wherein the outer wall of the first chamber comprises a first outer wall, wherein the second chamber comprises a second outer wall disposed radially outwards of the second impeller, wherein the second outer wall shrouds the second chamber from a proximal opening of the second chamber to a distal opening of the second chamber and around a circumference of the second chamber.

5. The compressor of claim 4, wherein the second outer wall is affixed to the second impeller.

6. The compressor of claim 1, wherein one or more of the first impeller or the second impeller comprises a mixed-flow impeller, wherein when the medium exits one or more of the first chamber or the second chamber containing the mixed-flow impeller, the mixed-flow impeller is configured to cause the medium to flow axially and radially relative to the longitudinal axis.

7. The compressor of claim 1, wherein the compressor comprises one or more seals disposed at one or more of:

a proximal end of the outer wall of the first chamber between the first chamber and the second chamber; or a distal end of the outer wall of the first chamber between the first chamber and the second chamber, wherein the one or more seals are configured to inhibit flow of the medium between the first chamber and the second chamber.

8. The compressor of claim 1, further comprising a compressor body radially inwards of the first compressor wheel, wherein the compressor body defines an inner lumen configured to receive a drive shaft, and wherein the compressor is configured to rotate about the longitudinal axis in response to rotation of the drive shaft.

9. The compressor of claim 1, further comprising a housing disposed radially outwards of the second compressor wheel, wherein the housing defines one or more channels configured to direct the medium from the first compressor wheel into the second compressor wheel.

10. A compressor comprising:

a first compressor wheel comprising:

a first chamber configured to retain a medium;

a first impeller disposed within the first chamber, wherein the first impeller is configured to revolve around a longitudinal axis of the compressor and within the first chamber; and a first diffuser fluidically connected to the first chamber, wherein the first diffuser is configured to output the medium from the first chamber; and a second compressor wheel comprising:

a second chamber disposed radially outwards of the first chamber relative to the longitudinal axis, wherein the second chamber is separated from the first chamber by a first outer wall, wherein the second chamber is configured to receive the outputted medium from the first chamber, and wherein the second chamber comprises a second outer wall radially outwards of the first outer wall;

a second impeller disposed within the second chamber and radially inwards of the second outer wall, wherein the second impeller is configured to revolve around the longitudinal axis within the second chamber; and a second diffuser fluidically connected to the second chamber, wherein the second diffuser is configured output the medium from the second chamber, wherein the second outer wall shrouds the second chamber from a first opening of the second chamber to a second opening of the second chamber and around an outer circumference of the second chamber.

11. The compressor of claim 10, wherein the second impeller comprises a plurality of blades, and wherein each blade of the plurality of blades is affixed to at least one of the first outer wall or the second outer wall.

12. The compressor of claim 10, wherein the first impeller comprises a plurality of blades, wherein each blade of the plurality of blades defines a fillet extending along a radially outward-most edge of the respective blade, and wherein a width of the fillet along a surface of the respective blade varies along the longitudinal axis.

13. The compressor of claim 12, wherein the first chamber extends from a proximal opening to a distal opening along the longitudinal axis, wherein the first diffuser is coupled to the distal opening, and wherein the width increases from a first end of the first diffuser at the proximal opening of the first chamber to a second end of the first diffuser at the distal opening of the first chamber.

14. The compressor of claim 12, wherein the plurality of blades comprises first plurality of blades, wherein the fillet comprises a first fillet, wherein the width comprises a first width, wherein the second impeller comprises a second plurality of blades, and wherein each blade of the second plurality of blades defines a second fillet extending along a radially outward-most edge of the respective blade, and wherein a second width of the second fillet along a surface of the respective blade varies along the longitudinal axis.

15. The compressor of claim 10, wherein the first diffuser comprises a plurality of vanes disposed around a circumference of the first diffuser, wherein the first impeller comprises a plurality of blades, each blade of the plurality of blades defining a curvature in a first direction along a reference plane orthogonal to the longitudinal axis, and wherein each vane of the plurality of vanes defines a curvature in a second direction along the reference plane, wherein the first direction is different from the second direction.

16. The compressor of claim 10, wherein one or more of the first impeller or the second impeller comprises a mixed-flow impeller, wherein when the medium exits one or more of the first chamber or the second chamber containing the mixed-flow impeller, the mixed-flow impeller is configured to cause the medium to flow axially and radially relative to the longitudinal axis.

17. The compressor of claim 10, wherein the compressor comprises one or more seals disposed at one or more of:

a proximal end of the first outer wall between the first chamber and the second chamber; or a distal end of the first outer wall between the first chamber and the second chamber, wherein the one or more seals are configured to inhibit flow of the medium between the first chamber and the second chamber.

18. A method of manufacturing a compressor, the method comprising:

forming a first chamber of a first compressor wheel around a longitudinal axis;

disposing a first impeller of the first compressor wheel within the first chamber, wherein the first impeller is configured to revolve around the and within the first chamber;

affixing a first diffuser of the first compressor wheel to the first chamber, wherein the first diffuser is configured to output the medium from the first chamber;

disposing a second chamber of a second compressor wheel radially outwards of the first chamber relative to the longitudinal axis, wherein the second chamber is separated from the first chamber by a first outer wall, and wherein the second chamber is configured to receive the outputted medium from the first chamber;

disposing a second impeller of the second compressor wheel within the second chamber, wherein the second impeller is configured to revolve around the longitudinal axis within the second chamber; and affixing a second diffuser of the second compressor wheel to the second chamber, wherein the second diffuser is configured output the medium from the second chamber.

19. The method of claim 18, wherein disposing the first impeller within the first chamber comprises:

forming the first impeller within the first chamber; and enclosing the first impeller within the first chamber via the first outer wall.

20. The method of claim 18, wherein disposing the second impeller within the second chamber comprises:

forming the second impeller within the second chamber, and enclosing the second impeller within the second chamber via a second outer wall.

* * * * *